US006296980B1

(12) United States Patent
Oshiba et al.

(10) Patent No.: US 6,296,980 B1
(45) **Date of Patent: *Oct. 2, 2001**

(54) TONER FOR DEVELOPING ELECTROSTATIC IMAGE AND IMAGE FORMING METHOD

(75) Inventors: Tomomi Oshiba; Ken Ohmura; Takao Yamanouchi; Asao Matsushima; Shigenori Kouno, all of Hachioji (JP)

(73) Assignee: Konica Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/439,396

(22) Filed: Nov. 15, 1999

(30) Foreign Application Priority Data

Nov. 16, 1998 (JP) ..... 10-325513
Oct. 26, 1999 (JP) ..... 11-304004

(51) Int. Cl.[7] ..... G03G 9/08
(52) U.S. Cl. ..... 430/111; 430/120
(58) Field of Search ..... 430/106, 109, 430/111

(56) References Cited

U.S. PATENT DOCUMENTS 4,996,126 * 2/1991 Anno et al. ..... 430/111
6,013,405 * 1/2000 Takano et al. ..... 430/111
6,022,662 * 2/2000 Matsumura et al. ..... 430/111

* cited by examiner

*Primary Examiner*—John Goodrow
(74) *Attorney, Agent, or Firm*—Jordan B. Bierman; Bierman, Muserlian and Lucas

(57) ABSTRACT

Disclosed is a toner for developing electrostatic image, comprising a resin and colorant. The toner has a variation coefficient of shape coefficient of not more than 16 percent and a number variation coefficient in the number particle size distribution of not more than 27 percent. An image forming method employing the toner is also disclosed.

44 Claims, 9 Drawing Sheets

TONER FOR DEVELOPING ELECTROSTATIC IMAGE AND IMAGE FORMING METHOD

FIELD OF THE INVENTION

The present invention relates to a toner for developing electrostatic image and an image forming method employing the toner, applied to a copying machine a printer and so on.

BACKGROUND OF THE INVENTION

In the electrophotography heat-pressure fixing method in which an image folding material having an image formed with toner is transferred between heating roller and pressure roller to fix the image, is widely employed because the apparatus therefor is simple and fixing property to a support such as a paper is satisfactory. In this method transmission of heat to the toner is caused by contact with the heating roller, and toner is fused by the heat. This method has disadvantage to tend to bring offset phenomenon, which fused toner adheres to the heat roller, as fused toner contact with the heating roller.

Various means for improving image disarrange caused by the offset have been proposed. In general the offset is explained as it occurs in case that adhesive force between the toner and heating parts such as heating roller is greater than the inner coagulation force. On the other hand, many methods of addition of agent giving releasing ability into a toner are proposed in view of the adhesion to heating device. Further, methods to prevent offset phenomenon by coating silicone oil etc. on a heating device is also proposed. These method demonstrate the effect by employed solely or in combination.

There is another problem of fixing property in heat-pressure fixing, which adhesion characteristics to a transfer material such as paper. There are methods employing with high fixing temperature or rather induce offset phenomenon. For these reasons, many improvement methods have been proposed of resins as for fixablity in view of viscosity when the toner melts.

It is a extremely important problem how to obtain wider fixable temperature range between the fixable minimum temperature and the temperature at which offset occurs. The problem has not been dissolved satisfactory, particularly, for small particle size toner and color tone.

There have been other subjects such as obtaining high quality image at initial stage, preventing of grade down of image quality as repeating employing, and preventing poor image in a process utilizing electrostatic image developing toner. For example, the problems includes gradation characteristics, reproduction ability of fine lines, change of image density, uneven image density, fogging. These are manly caused by unstable toner charging quantity, which is difficult in controlling. Stabilizing and controlling of charge quantity of toner are extremely difficult as the charging is caused triboelectrically.

Various kinds of improvement such as binder resin for toner, charge control agent, external additives, other additives and so on, have been proposed for above mentioned problems. However, further improvement in higher image quality and higher durability of developer are demanded in accordance with the progress of performance and reliability in each step of image forming process utilizing the toner.

In recent years, the electrophotography has been applied to various fields. For example, printer for output terminal of computer, color copying machine, color printer in addition to monochrome copying machine. As advancing of utility for the area, higher image quality is much more demanded. Variation of hue of secondary color by superposing color images becomes remarkable because of slight change of developing property (amount of residual toner) caused by very little change of charging characteristics etc., or change of transferring characteristics of half tone image in the image forming method in which toner images by color toner are superposed multiply. And consequently demand for stabilizing charging characteristics becomes extremely strict. Similarly stabilization of charging characteristics is demanded extremely strict in image forming method employing digital exposing which requires reproduction of fine lines.

SUMMARY OF THE INVENTION

The object of the invention is to provide a toner capable of forming images which exhibit minimal offsetting, excellent fixing property, developability, fine line reproducibility, and forming high quality images over a long period of time and an image forming method employing the toner.

The invention and embodiments of the invention are described.

1. A toner for developing electrostatic image comprising a resin and colorant wherein the toner has a variation coefficient of shape coefficient of not more than 16 percent and a number variation coefficient in the number particle size distribution of not more than 27 percent.

2. The toner described above wherein at least 65 percent of toner particles has a shape coefficient in the range of 1.0 to 1.6.

3. The toner described above wherein at least 65 percent of toner particles has a shape coefficient in the range of 1.2 to 1.6.

4. The toner described in above items 1 to 3, wherein at least 50 percent of toner particles in number have no corners.

5. The toner described above in items 1 to 4, wherein number average particle diameter of toner particles is 3 to 8 $\mu$m.

6. The toner described above in 1 to 5, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in $\mu$m) represents the particle diameter of a toner particle, while being divided into a plurality of classes at intervals of 0.23, and number of particles is used as an ordinate.

7. The toner described in above 1 to 6, wherein the toner is prepared by polymerizing polymerizable monomers an aqueous medium.

8. The toner described above in 1 to 7, wherein the toner is prepared by a method wherein resin particles are associated in an aqueous medium.

9. A toner for developing electrostatic image comprising a resin and colorant wherein at least 50 percent of toner particles in number have no corners and the toner particles have a number variation coefficient in the number particle size distribution is not more than 27 percent.

10. The toner described in above item 9 wherein at least 65 percent of toner particles has a shape coefficient in the range of 1.0 to 1.6.

11. The toner described in above item 9 wherein at least 65 percent of toner particles has a shape coefficient in the range of 1.2 to 1.6.

12. The toner described in above items 9 to 11, wherein number average particle diameter of toner particles is 3 to 8 μm.

13. The toner described in above items 9 to 12, wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

14. The toner described in above items 9 to 13 wherein the toner is prepared by polymerizing polymerizable monomers an aqueous medium.

15. The toner described in above items 9 to 14 wherein the toner is prepared by a method wherein resin particles are associated in an aqueous medium.

16. A toner for developing electrostatic image comprising a resin and colorant wherein at least 65 percent of toner particles has a shape coefficient in the range of 1.0 to 1.6 and a variation coefficient of shape coefficient of not more than 16.

17. The toner described in above item 16 wherein at least 50 percent of toner particles in number have no corners.

18. The toner described in above items 16 or 17 wherein number average particle diameter of toner particles is 3 to 8 μm.

19. The toner described in above items 16 to 18 wherein the has a sum M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

20. The toner described in above items 16 to 19 wherein the toner is prepared by polymerizing polymerizable monomers an aqueous medium.

21. The toner described in above items 16 to 20 wherein the toner is prepared by a method wherein resin particles are associated in an aqueous medium.

22. An image forming method in which an electrostatic latent image formed on photoreceptor and a developer material are arranged face to face in a non-contact state and images are visualized by jumping only toner comprising resin and colorant, wherein the toner has a variation coefficient of shape coefficient of not more than 16 percent and a number variation coefficient in the number particle size distribution of not more than 27 percent.

23. The image forming described in above item 22 wherein at least 65 percent of toner particles has a shape coefficient in the range of 1.0 to 1.6.

24. The image forming method described in above item 22 wherein at least 65 percent of toner particles has a shape coefficient in the range of 1.2 to 1.6.

25. The image forming method described in above items 22 to 24 wherein at least 50 percent of toner particles in number have no corners.

26. The image forming method described in above items 22 to 25 wherein number average particle diameter of toner particles is 3 to 8 μm.

27. The image -forming method described above items 22 to 26 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

28. The image forming method described above items 22 to 27 wherein the toner is prepared by polymerizing polymerizable monomers an aqueous medium.

29. The image forming method described in above items 22 to 28 wherein the toner is prepared by a method wherein resin particles are associated in an aqueous medium.

30. An image forming method in which an electrostatic latent image formed on photoreceptor and a developer material are arranged face to face in a non-contact state and images are visualized by jumping only toner comprising resin and colorant, wherein at least 50 percent of toner particles in number have no corners and a number variation coefficient in the number particle size distribution of not more than 27 percent.

31. The image forming method described above item 30 wherein at least 65 percent of toner particles has a shape coefficient in the range of 1.0 to 1.6.

32. The image forming method described in above item 30 wherein at least 65 percent of toner particles has a shape coefficient in the range of 1.2 to 1.6.

33. The image forming method described in above items 30 to 32 wherein number average particle diameter of toner particles is 3 to 8 μm.

34. The image forming method described in above items 30 to 33 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

35. The image forming method described in above items 30 to 34 wherein the toner is prepared by polymerizing polymerizable monomers an aqueous medium.

36. The image forming method described in above items 30 to 35 wherein the toner is prepared by a method wherein resin particles are associated in an aqueous medium.

37. An image forming method in which an electrostatic latent image formed on photoreceptor and a developer material are arranged face to face in a non-contact state and images are visualized by jumping only toner comprising resin and colorant, wherein at least 65 percent of toner particles has a shape coefficient in the range of 1.2 to 1.6 and the toner has a variation coefficient of shape coefficient of not more than 16 percent.

38. The image forming method described in above item 37 wherein at least 50 percent of toner particles in number have no corners.

39. The image forming method described in above item 37 to 38 wherein number average particle diameter of toner particles is 3 to 8 μm.

40. The image forming method described in above items 37 to 39 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

41. The image forming method described in above items 37 to 40 wherein the toner is prepared by polymerizing polymerizable monomers an aqueous medium.

42. The image forming method described in above items 37 to 41 wherein the toner is prepared by a method wherein resin particles are associated in an aqueous medium.

DETAILED DESCRIPTION OF THE INVENTION

Figure 1:
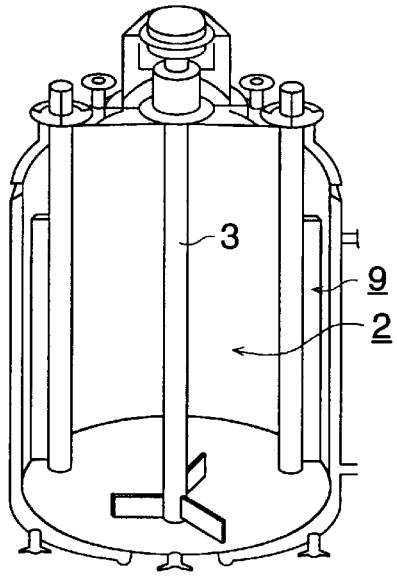
FIG. 1(*a*) to FIG. 1(*i*) are each a schematic view showing an example of a stirring unit.
Figure 1:
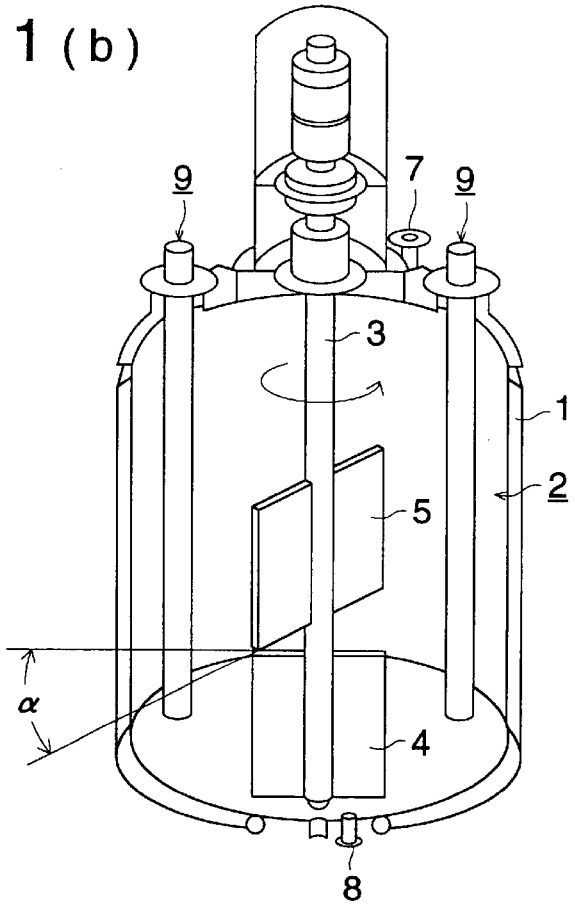
Figure 1:
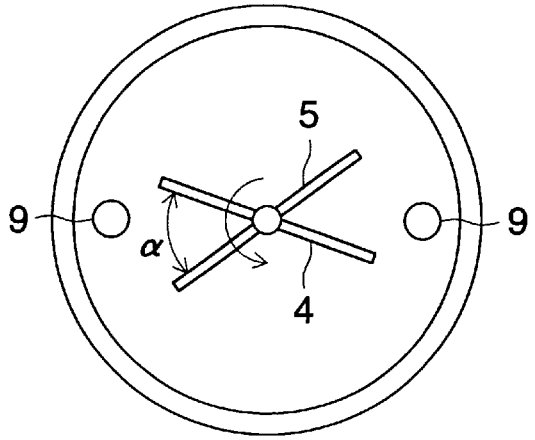
Figure 1:
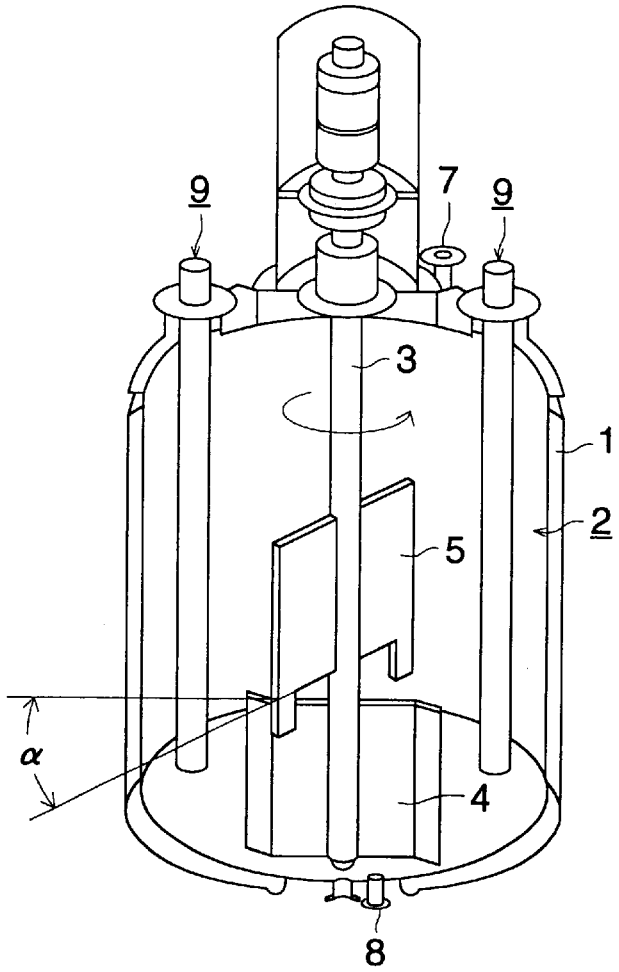
Figure 1:
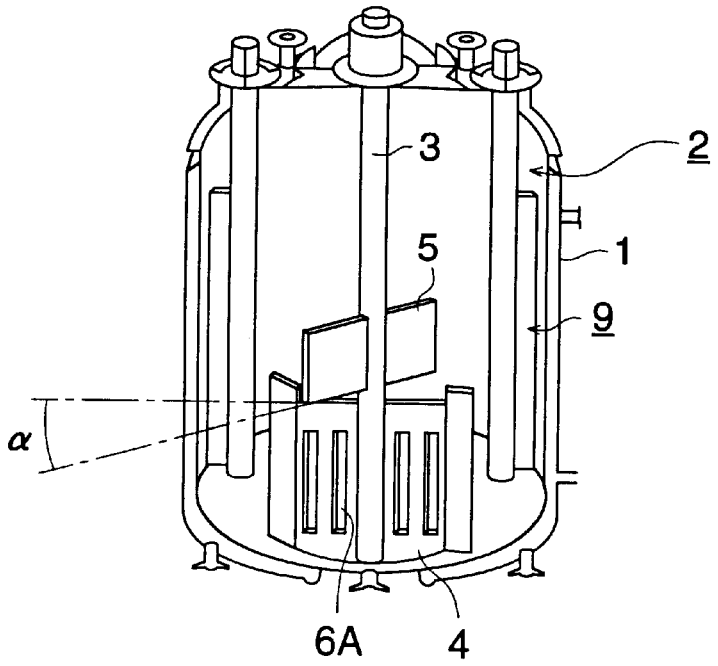
Figure 1:
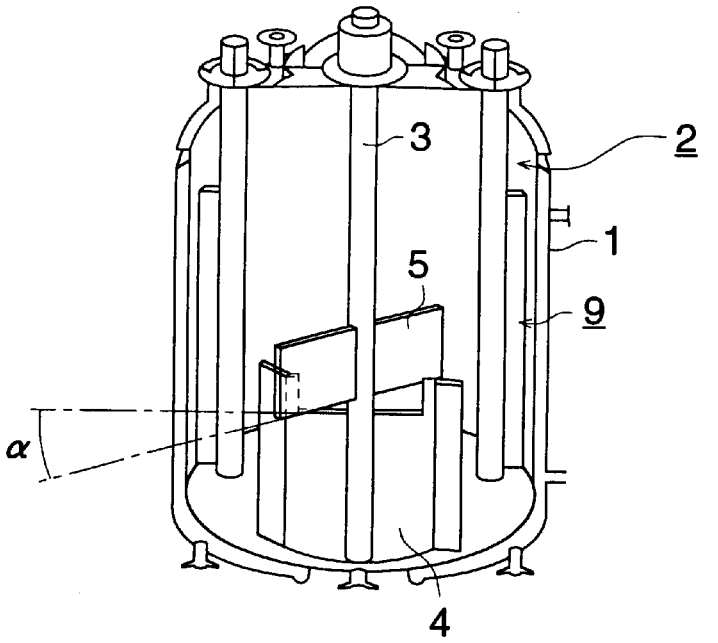
Figure 1:
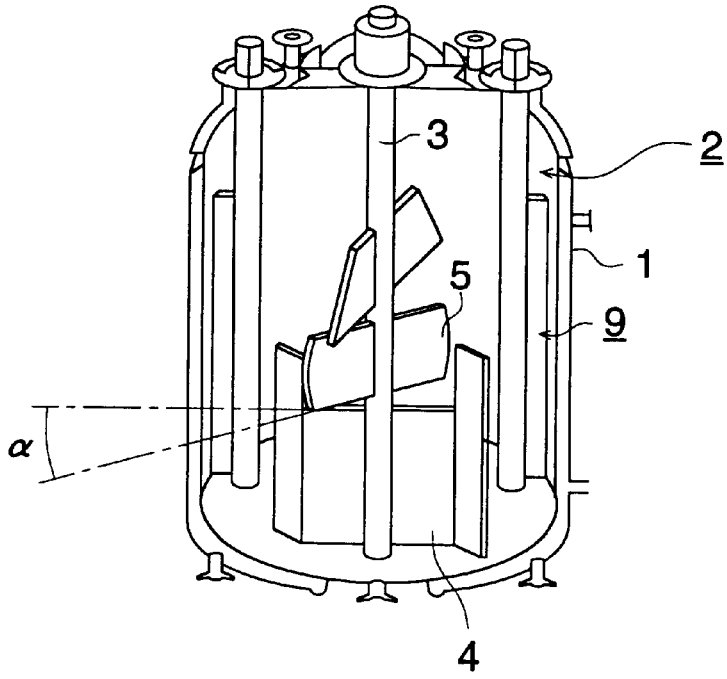
Figure 1:
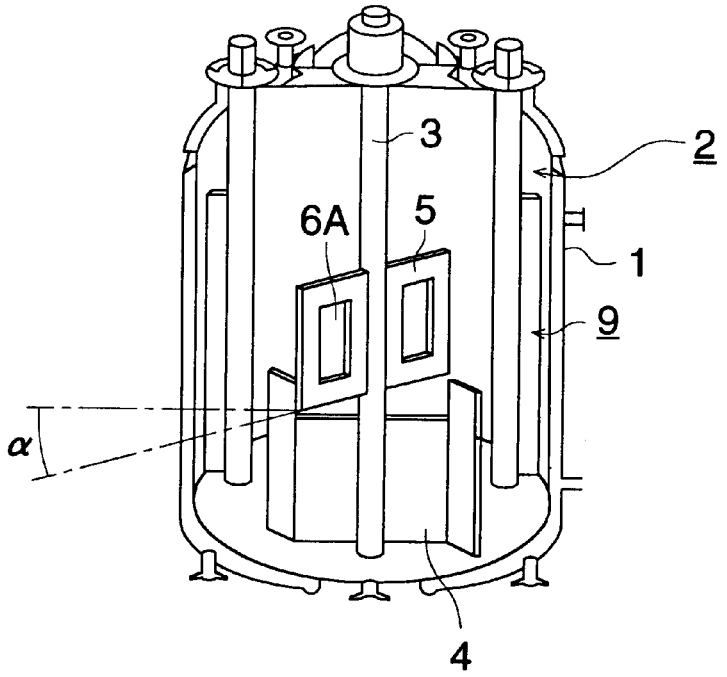
Figure 1:
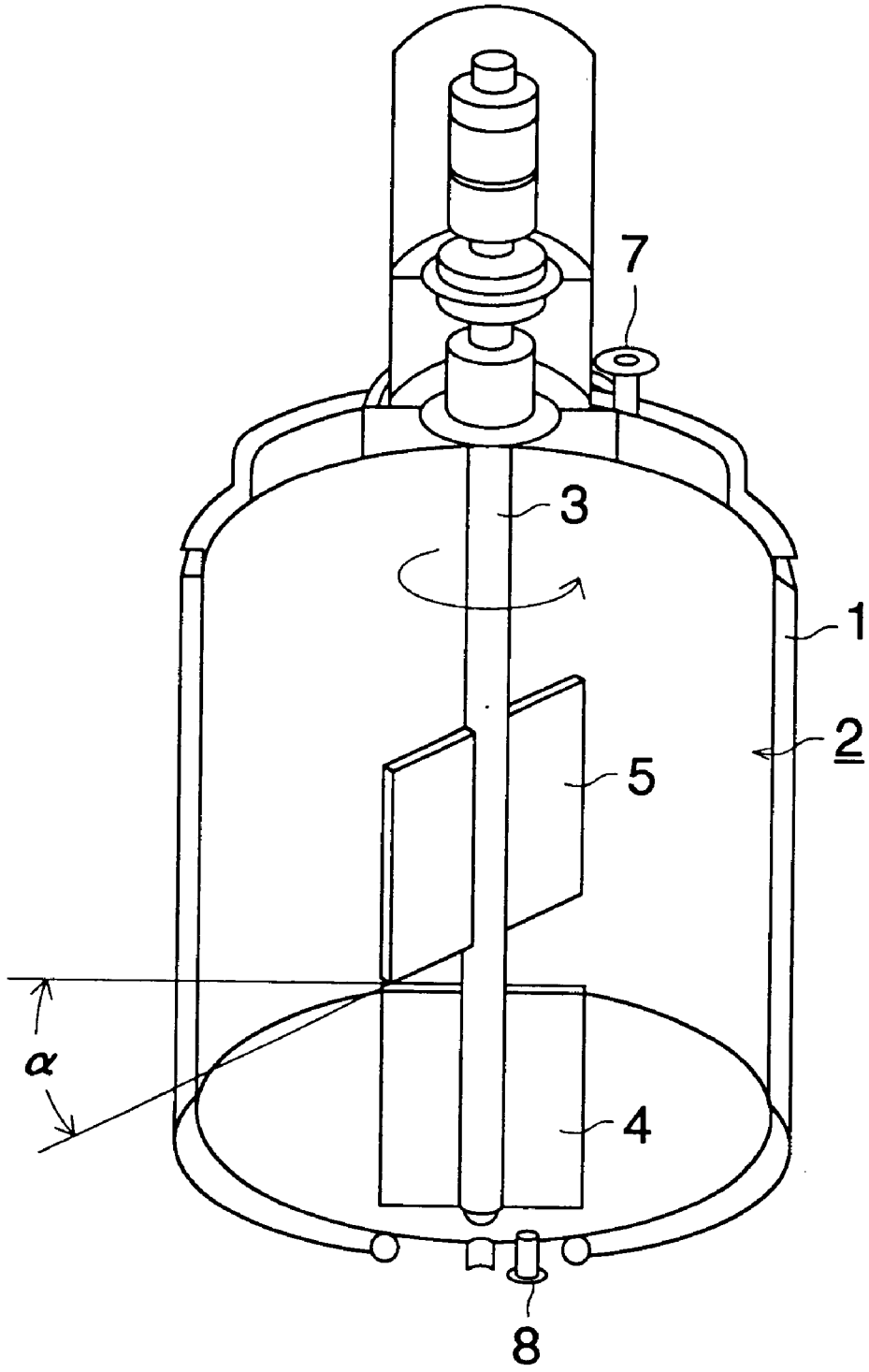

Generally, a toner, which is transferred to a transfer material such as a sheet of paper, does not form a single toner layer but forms multiple toner layers. Furthermore, in the fixed image after passing a fixing device, its surface becomes fairly smooth due to fusing and in said toner, in such a state, no original shapes remain. However, in the interior of the toner layer, toner particles are less deformed from the toner layer surface toward the transfer material, while voids increase, and toner particles, which have shapes almost nearly the original, have been observed.

As a result, regarding the phenomena of toner offsetting, it has been revealed that in the portion in which the toners in the interior of the toner layer are less deformed and are less fused with each other, one portion of the toner layer occasionally breaks and adheres to a heating member, causing offsetting. Furthermore, it has been revealed that such a portion tends to break in fixing property tests such as a rubbing test and the like. Further, when heating is carried out so that the entire toner layer fuses sufficiently, the portion in contact with a heating member is excessively heated, resulting in offsetting in said portion.

The inventors of the present invention have paid particular attention to voids in the interior of the toner layer, as well as to toner particles which are subjected to minimal mutual fusing. As a result, said inventors have assumed that the above-mentioned problems in fixing could basically be solved by making all toner particles of uniform shape, by making all toner particles of uniform particle diameter, by making the particle size distribution narrow, by making toner particles of specified shape, or by combination of these. Namely, it has been assumed that by making all toner particles of uniform shape and particle diameter as much as possible, the packing density of the toner layer increases while voids decrease, or by making the surface of toner particles smooth, the contact area between toner particles increases to promote fusing between toner particles and as a result, coagulation breakdown is less likely to occur.

By studying results of investigation by the inventors, it has been found that lowered offsetting tendency as well as fixing property is much enhanced by employing a toner having a variation coefficient of shape coefficient of not more than 16 percent and a number variation coefficient in the number particle size distribution of not more than 27 percent.

Furthermore, as results of diligent investigation of said inventors, it has been revealed that in toner particles which have rounded corners, even though those surfaces are smooth, fusing with each other is enhanced, and said fusing enhancement is applicable to toner particles which are not sufficiently uniform in shape. It has been found that the lowered offsetting tendency as well as the fixing property is much enhanced by employing a toner which is composed of at least 50 percent of toner particles in number having rounded corners and which has a number variation coefficient of a shape coefficient of not more than 27 percent.

Further, as the results of diligent investigation of said inventors, it has been found that, regarding the toner particles having a specified shape, when making all the toner particles of a uniform specified shape, packing density in the toner layer increases for a decrease in void and the similar effects are obtained. Namely it has been found that the lowered offsetting tendency as well as the fixing property is much enhanced by employing a toner which is composed of at least 65 percent of toner particles having a shape coefficient in the range of 1.2 to 1.6 and has a variation coefficient of the shape coefficient of not more than 16 percent, and the present invention has accomplished.

Another object of the present invention is to provide a toner which exhibits excellent developability as well as excellent fine line reproducibility and is capable of forming high quality images over a long period of time. It has been found that said object is accomplished by the same means.

The present inventors have studied toner particles which tend to stain the carrier, the development sleeve, and the charging member. As a result, it has been found that when an image forming process is repeated, toner particles having a non-uniform shape and portions forming corners, tend to generate staining. Though this reason is not yet clarified, it is assumed that when the shape of toner particles is not uniform, said toner particles are readily subjected to mechanical stress due to agitation and the like in the interior of a development device, and owing to the formation of portions subjected to excessive stress, the toner composition migrates and adheres onto a stainable material, resulting in variations in the chargeability of the toner.

Furthermore, difference in application of such stress depends on the diameter of the toner particles. Toner with a small particle diameter exhibits a higher adhesion force. Therefore, when said toner is subjected to stress, it is found that staining tends to occur. Toner with a larger particle diameter tends not to cause such staining, but causes problems with degradation of image quality, such as resolution and the like.

Further, the initial charge amount distribution of a toner is much concerned with such staining. When the charge amount distribution is wide, problems occur in which so-called selective development occurs during an image forming process and toner particles which are not likely employed for development is accumulated in the interior of a development device to degrade toner developability, the accumulated toner causes staining due to stress application over a long period of time, and the chargeability of the accumulated toner varies due to variation of the surface properties, and a weakly chargeable toner or a reverse polarized toner is generated to degrade image quality.

Such charge amount distribution of toner has been investigated. As a result, it has been found that in order to markedly narrow the charge amount distribution of the toner, it is necessary to minimize fluctuations of the particle diameter of the toner particles as well as to minimize fluctuations of the shape. By making the charge amount distribution narrow, it is possible to obtain stable chargeability over a long period of time even in the case of setting the toner charge amount at a low level.

Investigation has been carried out, based on the viewpoint described above,. As a result, it has been found that by employing a toner having a variation coefficient of the shape coefficient of not more than 16 percent and a number variation coefficient in the number particle size distribution of not more than 27 percent, developability as well as fine line reproducibility is excellent and high quality images may be formed over a longer period of time, by which the present invention has been accomplished.

Further more, the present inventors have made investigation while paying special attention to the fine shape of each toner particle. As a result, it has been found that in the interior of a development device, corner portions of toner particles are varied to be round and those portions cause staining. Though the reason is not yet clear, it has been assumed that the corner portions are more likely to be subjected to stress and a toner composition migrates and adheres to a stainable material due to the abrasion and breakdown of those portions, varying the chargeability of the toner.

Furthermore, it is assumed that when toner particles are triboelectrically charged, the resulting charge is likely concentrated on the corner portions, and the charge on individual toner particles is likely not uniform.

Namely, it has been found that by employing a toner in which at least 50 percent of toner particles are composed of those having no corners, and by controlling the number variation coefficient of the number particle size distribution to be not more than 27 percent, developability as well as fine line reproducibility is enhanced and high quality images are formed over a long period of time, so that the present invention is accomplished.

Further, it has been found that when making all toner particle of a uniform and specified shape, staining due to toner composition decreases and the charge amount distribution becomes narrow.

Namely, it has been found that by employing a toner in which toner particles are composed of at least 65 number percent of particles having a shape coefficient in the range of 1.2 to 1.6, and which has a variation coefficient of the shape coefficient of not more than 16 percent, developability as well as fine line reproducibility is enhanced and high quality images are formed over a long period of time, so that the present invention is accomplished.

Furthermore, an image forming method is employed in which a photoreceptor and a developer material are arranged face to face in a non-contact state, and images are visualized only by jumping toner. Said method is employed to form multicolor images by superimposing a plurality of color toners. However, due to no contact development, development efficiency tends to decrease compared to contact development, and during repeated image formation, selective development due to chargeability tends to occur. As a result, the variation in the amount of used development toner is large and variation in image quality, such as variation in hue of secondary colors formed by color superposing, becomes large.

It has been found that since the toner of the present invention, as described above, has a narrow charge amount distribution and is capable of maintaining stable chargeability over a long period of time, in the above-mentioned image forming method, developability as well as fine line reproducibility is markedly improved and more high quality images may be formed over a long period of time, whereby the present invention has been accomplished.

The shape coefficient of the toner of the present invention is represented by the formula described below and shows the degree of roundness of toner particles.

$$\text{Shape coefficient}=[(\text{Maximum diameter}/2)^2\times\pi]/\text{Projection area}$$

Wherein the maximum diameter denotes the width of a particle, which is the distance between parallel lines when a projected image of a toner particle on a screen is placed between said parallel lines and the distance between said parallel lines becomes maximum. Further, the projection area denotes the area of the projected image of a toner particle on a screen.

In the present invention, said shape coefficient was measured as follows. Toner particles were magnified to a factor of 2000 employing a scanning electron microscope and a photograph of said magnified toner particles was taken. The resulting photographic images were analyzed employing a Scanning Image Analyzer (manufactured by Nippon Denshi Co.). One hundred toner particles were measured and the shape coefficient of the present invention was calculated according to the above-mentioned formula.

The ratio of toner particles which have said shape coefficient in the range of 1.0 to 1.6 is preferably at least 65 percent by number, and is more preferably at least 70 percent by number. Still more preferably, the ratio of toner articles which have said shape coefficient in the range of 1.2 to 1.6 is at least 65 percent by number, and is more preferably at least 70 by number percent.

When the ratio of toner particles which have said shape coefficient in the range of 1.0 to 1.6 is at least 65 percent, by number, the packing density of the toner layer transferred to a transfer material increases. As a result, fixing property is improved and offsetting is less likely to be caused. Furthermore, toner particles are not as likely to break down, decreasing staining on charging members, and stabilizing toner chargeability as well.

Furthermore, the ratio of toner particles which have said shape coefficient being preferably in the range of 1.2 to 1.6 is at least 65 percent by number, and is in particular preferably at least 70 percent by number.

Methods to control said shape coefficient are not particularly limited. One method is in which a toner having a shape coefficient of 1.0 to 1.6, or 1.2 to 1.6, is prepared, employing any of several methods in which, for example, toner particles are sprayed into a heated air flow; toner particles are repeatedly subjected to application of mechanical energy in a gas phase employing an impact force; toner is added to a solvent which does not dissolve the toner and is subjected to application of circulation flow; and the like, is added to ordinary toner and the resulting mixture is prepared so as to be in the range specified by the present invention. Furthermore, another method is one in which during the preparation of a so-called polymerization method toner, all shapes are controlled, and the toner, which is controlled so as to have a shape coefficient of 1.0 to 1.6 or 1.2 to 1.6, is added to an ordinary toner in the same manner as above to prepare a toner.

Of the above-mentioned methods, to prepare a toner, the polymerization method is preferred, due to the fact that it is simple and easy as a production method, the surface uniformity is excellent, compared to a pulverized toner, and the like.

The toner of the present invention may be prepared employing a method in which fine polymerization particles are prepared employing a suspension polymerization method, or a method in which monomers undergo emulsion polymerization in a solution to which an emulsified composition of necessary additives is added, and thereafter, association is carried out by adding organic solvents, coagulants, and the like. During said association, listed are methods in which preparation is carried out in such a manner that a dispersion of releasing agents, colorants, and the like, which are required to constitute a toner, is mixed and association is carried out, emulsion polymerization is carried out upon dispersing toner components such as releasing agents, colorants, and the like into monomers, and the like. Said association as described herein denotes that a plurality of resin particles and colorant particles are allowed to fusing with each other.

Further, the aqueous medium as described in the present invention denotes one, which comprises water in an amount of at least 50 percent by weight.

Namely, various constitution materials such as colorants, and if desired, releasing agents, charge control agents, further polymerization initiators, and the like are incorporated into polymerizable monomers, and each of the constitution materials is dissolved in or dispersed into the polymerizable monomers employing a homogenizer, a sand mill, a sand grinder, an ultrasonic homogenizer, and the like. The polymerizable monomers, into which these various constitution materials are dissolved or dispersed, are dispersed into an aqueous medium comprising a dispersion stabilizer so as to form oil droplets having a desired size. Thereafter, the resulting dispersion is transferred to a reaction apparatus having a stirring mechanism composed of stirring blades described below, and undergoes polymerization reaction upon raising its temperature. After completing the reaction, the dispersion stabilizer is removed, filtered, washed, and further dried to prepare the toner of the present invention.

Furthermore, also listed as a method to produce the toner of the present invention may be a method in which resin particles are prepared upon associating or fusing with each other in an aqueous medium. This method is not particularly limited, and other methods may be listed which are disclosed in, for example, Japanese Patent Publication Open to Public Inspection Nos. 5-265252, 6-329947, and 9-15904. Namely, the toner of the present invention is prepared employing a method in which a plurality of dispersion particles of the constitution materials comprised of resin particles, colorants and the like, or of fine particles comprised of resins, colorants, and the like, are associated, in which in particular, after dispersing these into water employing an emulsifier, the resulting dispersion is salted out by adding a coagulant in an amount of more than the critical coagulation concentration; at the same time, while forming fused particles upon heating the formed polymer at least to the glass transition temperature of the polymer, so as to fuse with each other, the particle diameter is increased; when growing the particle diameter to a desired diameter, a large amount of water is added to halt the growth of the diameter; the particle surface is then smoothed through heating and stirring, whereby the shape is controlled; and the resulting particles are heat dried in a fluid state while suspended in a water comprising state. Further, herein, organic solvents which are infinitely soluble in water may be added at the same time, together with a coagulating agent.

Employed polymerizable monomers to constitute a resin include styrenes or styrene derivatives such as styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate, and the like; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; acrylic acid or methacrylic acid derivatives such as acrylonitrile, methacrylonitrile, acrylamide and the like. These vinyl based monomers may be employed individually or in combination.

Furthermore, still more preferably employed as polymerizable monomers, which constitute a resin, are those having an ionic dissociation group in combination, which are, for example, have a substituent such as a carboxyl group, a sulfonic acid group, a phosphoric acid group, and the like as a group constituting the substituent. Listed as specific examples are acrylic acid, methacrylic acid, maleic acid, itaconic acid, cinnamic acid, fumaric acid, monoalkyl maleate, monoalkyl itaconate, styrenesulfonic acid, allylsulfosuccinic acid, 2-acrylamide-2-methylpropanesulfonic acid, acidphosoxyethyl methacrylate, 3-chloro-2-acidphophoxypropyl methacrylate, and the like.

Further, the resin may be modified so as to have a cross-linking structure, employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, and the like.

These polymerizable monomers may undergo polymerization employing a radical polymerization initiator. In such cases, oil-soluble polymerization initiators may be employed in a suspension polymerization method. Such oil-soluble polymerization initiators include azo based or diazo based polymerization initiators such as 2,2'-azobis-(2,4-dimethylvaleronitrile, 2,2'-azobisisobutyronitrile, 1,1'-azobis(cyclohexane-1-carbonitrile), 2,2-azobis-4-methoxy-2,4-dimethylvaleronitrile, azobisisobutyronitrile, and the like; and peroxide based polymerization initiators and polymer initiators having a peroxide in the side chain such as benzoyl peroxide, methyl ethyl ketone peroxide, disopropylperoxycarbonate, cumenehydroperoxide, t-butylhydroperoxide, di-t-butylperoxide, dicumylperoxide, 2,4-dichlorobenzoyloxide, lauroylperoxide, 2,2-bis-(4,4-t-butylperoxycyclohexyl)propane, tris-(t-butylperoxy) triazine, and the like.

Further, when the emulsion polymerization method is employed, water-soluble radical polymerization initiators may be employed. Water-soluble polymerization initiators include persulfates such as potassium persulfate, ammonium persulfate, and the like, azobisaminodipropane acetic acid salts, azobiscyanovaleric acid and salts thereof, hydrogen peroxide, and the like.

Listed as dispersion stabilizers may be tricalcium phosphate, magnesium phosphate, zinc phosphate, aluminum phosphate, calcium carbonate, magnesium sulfate, calcium hydroxide, magnesium hydroxide, aluminum hydroxide, calcium metasilicate, calcium sulfate, barium sulfate, bentonite, silica, alumina, and the like. Further, also employed as dispersion stabilizers may be those which are generally employed as surface active agents such as polyvinyl alcohol, gelatin, methyl cellulose, sodium dodecybenzenesulfonate, ethylene oxide additives, higher alcohol sodium sulfate, and the like.

Preferred as excellent resins in the present invention are those having a glass transition point of 20 to 90° C., as well as a softening point of 80 to 220° C. The glass transition point is a value measured by a differential calorimetric method, while the softening point can be measured by an elevated type flow tester. Further, these resins preferably have a number average molecular weight (Mn) of 1,000 to 100,000, as well as a weight average molecular weight (Mw) of 2,000 to 1,000,000, which are measured by gel permeation chromatography. Further, as a molecular weight distribution, the Mw/Mn is preferably between 1.5 and 100, and is most preferably between 1.8 and 70.

The employed coagulating agents are not particularly limited, however those selected from metal salts are more suitable. Specific examples include salts of univalent metals such as alkali metals, for example, sodium, potassium, lithium and the like; alkali earth metal salts of divalent metals such as calcium, magnesium, and the like; salts of divalent metals such as manganese, copper, and the like; and salts of trivalent metals such as iron, aluminum, and the like. Listed as specific salts can be sodium chloride, potassium chloride, lithium chloride, calcium chloride, zinc chloride, copper sulfate, magnesium sulfate, manganese sulfate, and the like. These may be employed in combination.

These coagulants are preferably added in an amount exceeding the critical coagulation concentration. The critical coagulation concentration as described herein is an index on the stability of an aqueous dispersion, and concentration at which coagulation is formed by the addition of a coagulant. The critical coagulation concentration varies greatly depending on the emulsified components and dispersing agents themselves. For example, the critical coagulation concentration is described in Seizo Okamoto, et al. "Kobunshi Kagaku (Polymer Chemistry)", edited by Nihon Kobunshi Gakkai, whereby detailed critical coagulation concentration data can be obtained. Furthermore, as another method, ζ (zeta) potentials of a specified particle dispersion are measured upon adding a desired salt to the particle dispersion, while changing the salt concentration, and said salt concentration which varies the ζ potential can be obtained as the critical coagulation concentration.

The added amount of the coagulant of the present invention is acceptable if it exceeds the critical coagulation concentration. However, the addition amount is preferably at least 1.2 times of the critical coagulation concentration, and is more preferably at least 1.5 times.

A solvent which is infinitely soluble denotes a solvent which is infinitely soluble in water and as such solvents, those which do not dissolve the resin formed in the present invention are selected. Specifically, cited are alcohols such as methanol, ethanol, propanol, isopropanol, t-butanol, methoxyethanol, butoxyethanol, and the like, nitrites such as acetonitrile, and ethers such as dioxane. In particular, ethanol, propanol and isopropanol are preferred.

The added amount of such solvents which are infinitely soluble is preferably between 1 and 100 percent by volume of the polymer containing dispersion to which the coagulant is added.

Further, in order to make all particles of a uniform shape, after preparing colored particles and filtering them, the resulting slurry, in which water is present in an amount of at least 10 percent by weight of the particles, is preferably subjected to fluidized drying. At the time, those which comprise a polar group in the polymer are particularly preferred. As the reason, it is assumed that since existing water somewhat exhibits swelling effect for the polymer comprising the polar group, making particles of a uniform shape tends to be particularly easily carried out.

The toner of the present invention comprises at least a resin and a colorant, but may as well comprise a releasing agent which works as a fixing property improving agent, a charge control agent, and the like. Further, external additives comprised of fine inorganic particles, fine organic particles, and the like may be added to toner particles which are mainly comprised of the above-mentioned resin and colorant.

Optionally employed as colorants, which are employed in the toner of the present invention, may be carbon blacks, magnetic materials, dyes, pigments, and the like. Employed as said carbon blacks are channel black, furnace black, acetylene black, thermal black, lamp black, and the like. Employed as magnetic materials may be ferromagnetic metals such as iron, nickel, cobalt, and the like, as well as alloys which do not comprise ferromagnetic metals and are subjected to thermal treatment to exhibit ferromagnetism, such types of alloys being called Heusler alloys, being for example, manganese-copper-aluminum, manganese-copper-tin and the like, and also chromium dioxide, and the like.

Employed as dyes can be C.I. Solvent Red 1, Solvent Red 49, Solvent Red 52, Solvent Red 63, Solvent Red 111, and Solvent Red 122, C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, and Solvent Yellow 162; C.I. Solvent Blue 25, Solvent Blue 36, Solvent Blue 60, Solvent Blue 70, Solvent Blue 93, and Solvent Blue 95, and the like. Furthermore, these mixtures may be employed. Employed as pigments may be C.I. Pigment Red 5, Pigment Red 48:1, Pigment Red 53:1, Pigment Red 57:1, Pigment Red 122, Pigment Red 139, Pigment Red 144, Pigment Red 149, Pigment Red 166, Pigment Red 177, Pigment Red 178, and Pigment Red 222; C.I. Pigment Orange 31, and Pigment Orange 43; C.I. Pigment Yellow 14, Pigment Yellow 17, Pigment Yellow 93, Pigment Yellow 94, and Pigment Yellow 138; and C.I. Pigment Green 7; and C.I. Pigment Blue 15:3, and Pigment Blue 60; and the like. These mixtures may also be employed. The average primary particle diameter varies depending on type, generally, however it is preferably between about 10 and about 200 nm.

The colorants may be added employing ant of several common methods, in which colorants are added during which polymer particles prepared by an emulsion polymerization method are coagulated by adding a coagulant and the polymer is tinted; during polymerizing of said monomers, a colorant is added and the resulting mixture is polymerized to form tinted particles; and the like. Further, when the colorant is added during polymer preparation, it is preferably subjected to surface treatment employing a coupling agent and the like, which is employed so that radical polymerization is not hindered.

Further, added as fixing property enhancing agents may be low molecular weight polypropylene (having a number average molecular weight of 1,500 to 9,000) or low molecular weight polyethylene.

Charge control agents may also be employed, which are known in the art, and can be dispersed into water. Specifically listed are Nigrosine based dyes, metal salts of naphthenic acid or higher fatty acids, alkoxylated amines, quartenary ammonium salts, azo based metal complexes, salicylic acid metal salts or metal complexes thereof, and such.

Further, these charge control agents and fixing property enhancing agents are preferably in a dispersed state, and the number average primary particle diameter is adjusted from about 10 to about 500 nm.

In a suspension polymerization method in which a composition, prepared by dispersing or dissolving toner constitution components such as a colorant and the like in polymerizable monomers, is suspended in a water based medium, and then undergoes polymerization to obtain the toner, the shape of toner particles may be controlled by controlling the flow of the medium in a reaction vessel in which the reaction is carried out. Namely, when many toner particles having a shape coefficient of at least 1.2 are formed, the flow in the reaction vessel is regulated to a turbulent one; polymerization proceeds; and when oil droplets suspended in the water based medium are gradually polymerized and oil droplets become soft particles, particle union is accelerated due to collisions of particles resulting in particles which are not stable in shape. Further, when spherical toner particles having a shape coefficient of not more than 1.2 are formed, the flow of the medium in said reaction vessel is regulated to a laminar flow to result in spherical particles upon minimal collisions between particles. Employing such methods, it is possible to control the toner shape distribution within the range specified by the present invention.

In the previously mentioned suspension polymerization, said turbulent flow may be generated employing specified stirring blades, and the shape may be readily controlled. The reason has not been clarified yet. When the structure of the stirring blades as shown in FIG. 1(*a*), which is generally used, is at one level, the flow of the medium generated in a stirring vessel is only composed of the flow from the lower portion to the upper portion along the wall in the stirring vessel. Owing to that, conventionally, a turbulent flow has generally been generated by arranging baffle plates on the wall and the like in the stirring vessel, by which stirring efficiency has been increased. However, in such a structured device, the turbulent flow may be generated locally, but the presence of the turbulent flow rather tends to restrain the flow of a fluid. As a result, shearing against particles decreases and the shape may not be controlled.

A preferably employed stirring vessel, equipped with stirring blades, will be described with reference to drawings. FIG. 1(*b*) is an example of a stirring vessel equipped with stirring blades. Vertical rotation shaft 3 is provided in the central portion in a longitudinal type cylindrical stirring vessel 2 equipped with jacket 1 for heat exchange on the circumferential portion of said stirring vessel, with integral lower level stirring blades 4 provided on said rotation shaft 3 near the bottom surface of the stirring vessel 2, and stirring blades 5 provided at the upper level. Stirring blades 5 at the upper level is provided so as to have an advanced crossed axes angle $\alpha$ in the rotational direction with respect to the stirring blades 4 positioned at the lower level. In the present invention, the crossed axes angle a is less than 90 degrees. The lower limit of the crossed axes angle is not particularly determined, however it is commonly at least 5 degrees, and is preferably at least 10 degrees. FIG. 1(*c*) is an upper cross-sectional view of this. In the case of three levels or more, the crossed axes angle $\alpha$ between adjacent stirring blades may be less than 90 degrees.

By such a constitution, it is assumed that a medium is first stirred by stirring blades provided at the upper level; a flow to the lower side is then generated; subsequently, the flow rate formed by the stirring blades at the upper level is accelerated downward by the stirring blades provided at the lower level; at the same time, a downward flow is separately formed by the stirring blades themselves; and as a whole, the flow rate is accelerated. As a result, it is assumed that since a flow region having a large shearing stress is formed as a turbulent flow, the toner shape can be regulated.

Further, in FIGS. 1(*b*) and 1(*c*), arrows show rotational directions, reference numeral 7 shows an upper material deeding inlet and 8 shows a lower material feeding inlet. Furthermore, 9 is a turbulent flow forming member to make stirring more effective.

Figure 2:
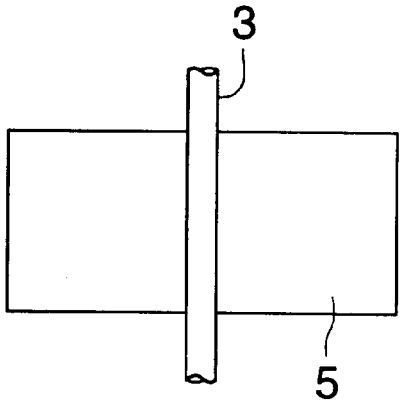
FIG. 2(*a*) to FIG. 2(*d*) are each a schematic view showing an example of stirring blades.
Figure 2:
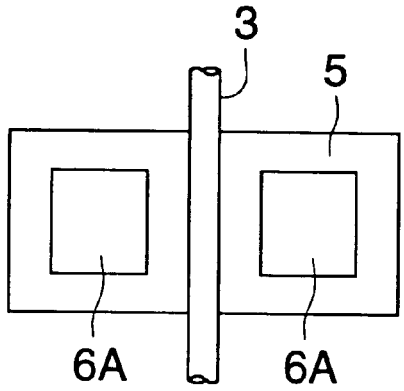
Figure 2:
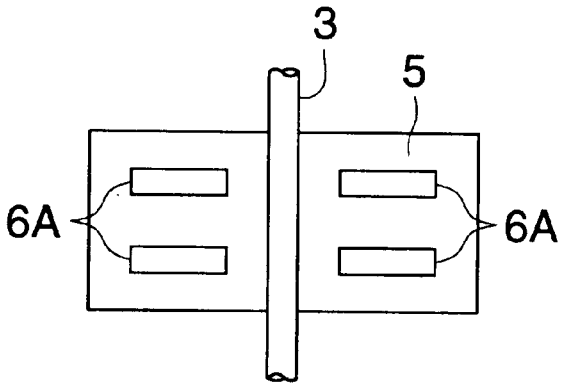
Figure 2:
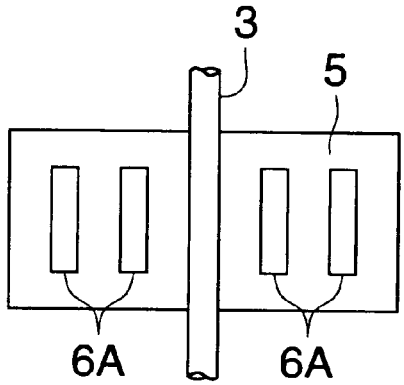

Herein, the shape of said stirring blades is not particularly limited, however employed may be those which include a square-shaped plate blade, a blade with parts partially cut away, a blade having at least one opening, e.g. a so-called slit blade, and the like. FIG. 2 shows these examples. FIG. 2(*a*) shows a blade having no opening, FIG. 2(*b*) shows a blade having large opening 6A in the center, FIG. 2(*c*) shows a blade having a long longitudinal opening 6A, and FIG. 2(*d*) shows a blade having long lateral opening 6A. Blades having the same or different openings 6A may be employed at the upper level and the lower level.

Furthermore, employed as preferred stirrer blade constitution, are those shown in FIGS. 1(*d*) through 1(*h*). FIG. 1(*d*) shows a constitution in which a stirring blade has extra portions or bent portions at both edges. FIG. 1(*e*) shows a constitution at which a stirring blade in the lower level has slits, and extra portions as well as bent portions at both edges. FIG. 1(*f*) shows a constitution in which a stirring blade at the lower level has extra portions as well as bent portion at both edges. FIG. 1(*g*) shows a constitution in which a stirring blade at the upper level has an opening and a stirring blade in the lower level has extra portions as well as bent portions at both edges. FIG. 1(*h*) shows a constitution in which stirring blades are provided at three levels. Further, the angle of the bent portion at the edges is preferably between 5 and 45 degrees.

Stirring blades having such bent portions or such extra portions at the top or bottom effectively generate the desired turbulent flow.

Further, the gap between the upper stirring blade and the lower one, which are arranged as described above, is not particularly limited, however a gap is preferably present between them. The reason has been not yet clear, but it is considered that the flow of a medium is formed through the gap, and accordingly, stirring efficiency is improved. However, the length of the gap is generally between 0.5 and 50 percent of the height of liquid in the standing state, and is preferably between 1 and 30 percent. Further, the size of the stirring blade is not particularly limited, however the total height of all stirring blades is between 50 and 100 percent of the height of liquid, and is preferably between 60 and 95 percent.

Furthermore, FIG. 1(*i*) shows an example of stirring blades as well as a stirring vessel which is employed to generate a laminar flow in the suspension polymerization method. It is characterized that obstacles such as baffle plates and the like, which generate a turbulent flow, are not provided. Stirring blades are preferably constituted in a multi-level configuration in which the upper stirring blade is positioned so as to make an advanced crossed axes angle $\alpha$ in the rotational direction with respect to the lower stirring blade, in the same manner as the case described above in which the stirring blade is employed to generate a turbulent flow.

The shape of said stirring blade is not particularly limited as long as it does not generate a turbulent flow. The stirring blade is preferably constituted of a continuous surface such as a square plate shown in FIG. 2(*a*), which may also have a curved surface.

On the other hand, for a toner prepared by a polymerization method in which resin particles are associated or fused in an aqueous medium, it is possible to optionally vary the shape distribution as well as the shape of the particles by controlling the flow of a medium and the temperature distribution in the reaction vessel during the fusing stage, and further by controlling the heating temperature, the rotational frequency while stirring, and the time during the shape controlling process, after fusing.

Namely, regarding the toner prepared by the polymerization method in which resin particles are associated or fused, it is possible to prepare a toner, having specific shape coefficient and the uniform shape distribution described in the present invention, by controlling the temperature, the rotation frequency and the time during the fusing process and shape controlling process, employing stirring blades as well as a stirring vessel which is capable of making the flow in the reaction vessel a laminar flow and the interior temperature distribution uniform. As the reason, it is assumed that when fusing is carried out in the location in which the laminar flow is generated, particles associated or coagulated particles) while undergoing coagulation and fusing are not subjected to strong stress, and in the laminar flow in which the flow rate is accelerated, the temperature distribution in the stirring vessel is uniform, and as a result, the shape distribution of fused particles becomes uniform. Further, the fused particles are gradually varied to spherical particles by heating and stirring in the subsequent shape controlling process, and the shape of toner particles may thus be optionally controlled.

Blades and a stirring vessel, which are employed to prepare a toner employing the polymerization method in which resin particles are associated or fused, may be employed which are similar to those which are employed to generate a laminar flow in the above-mentioned suspension polymerization method. For example, those shown in FIG. 1(*i*) may be employed. Features are that obstacles such as a baffle plate and the like are not provided. The stirring blades are preferably constituted at several levels in such a manner that the upper stirring blade is arranged so as to make an advanced crossed axes angle $\alpha$ in the rotational direction with respect to the lower stirring blade in the same manner as the case of the stirring blades which are employed for the above-mentioned suspension polymerization method.

The shape of said stirring blades may be those which is are employed to generate a laminar flow in the above-mentioned suspension polymerization method. The shape of the blades is not particularly limited, as long as it does not generate a turbulent flow, however said stirring blade is preferably constituted with a continuous surface such as a square plate shown in FIG. 2(*a*), and may alternatively have a curved surface.

The variation coefficient of the shape coefficient of the toner of the present invention is calculated by the formula below:

$$\text{Variation coefficient}=(S/K)\times 100 \text{ (in percent)}$$

wherein S denotes the standard deviation of the shape coefficient of 100 toner particles, and K denotes the average of the shape coefficient.

Said variation coefficient of the shape coefficient is generally not more than 16 percent, and is preferably not more than 14 percent. By maintaining the variation coefficient of the shape coefficient below 16 percent, voids in transferred toner layers decrease to improve fixing property as well as to minimize the formation of offsetting. Further, the charge amount distribution becomes narrower to improve overall image quality.

In order to uniformly control said toner shape coefficient as well as the variation coefficient of said toner shape coefficient so as to minimize lot fluctuations, during the process in which resin particles are subjected to polymerization, fusing, and shape controlling, the process may be appropriately terminated while monitoring properties of toner particles (tinted particles) which are being formed.

Monitoring as described herein means that process conditions are controlled based on measurements obtained by measurement devices incorporated into the production line. For example, when a toner is prepared employing the polymerization method in which resin particles are associated or fused in an aqueous medium, during the fusing process and the like, sampling is successively carried out to measure the shape as well as particle diameter, and when the targeted shape is obtained, the reaction is terminated.

The monitoring methods are not particularly limited, and a flow type particle image analyzer FPIA-2000 (manufactured by Toa Iyo Denshi Co.) may be used. Said device is suitably employed because shapes can be monitored in real-time from a flowing sample liquid. Namely, the particle shape and the like in a sample which is fed to said device from the reaction vessel, employing a pump, is continually monitored, and when the desired shapes are obtained, the reaction is terminated.

The number particle size distribution as well as the number variation coefficient of the toner of the present invention is measured by either a Coulter Counter TA-II or a Coulter Multisizer (both are manufactured by Coulter Co.). In the present invention, the Coulter Multisizer was used, which was connected to a particle size distribution output interface (manufactured by Nikkaki), via a personal computer. An aperture employed in said Coulter Multisizer was 100 $\mu$m, and the volume as well as the number of toner particles with at least 2 $\mu$m was measured to calculate the particle size distribution as well as the average particle diameter. The number particle size distribution as described herein represents the relative frequency of toner particles with respect to the toner diameter, and the number average particle diameter represents the median diameter in the number particle size distribution.

The number variation coefficient in the number particle size distribution of toner is calculated by the formula described below:

$$\text{Number variation coefficient}=(S/D_n)\times 100 \text{ (in percent)}$$

wherein S represents the standard deviation in the number particle size distribution, and $D_n$ represents the number average particle diameter (in $\mu$m).

The number variation coefficient of the toner of the present invention is generally not more than 27 percent, and is preferably not more than 25 percent. By controlling the number variation coefficient to be below 27 percent, voids in the transferred toner layer decrease to improve fixing property as well as to minimize offsetting. Further, the charge distribution narrows, and the transfer efficiency is enhanced, improving image quality.

Methods to control the number variation coefficient of the present invention are not particularly limited. For example, a method may be employed in which toner particles are classified employing forced airflow. However, in order to decrease the number variation coefficient, classification in liquid is more effective. Classifying methods in liquid include one in which a toner is prepared by classifying and collecting toner particles in response to the difference in sedimentation rate generated by the difference in particle diameter while controlling rotational frequency, employing a centrifuge.

Specifically, when a toner is produced employing the suspension polymerization method, a classifying operation is essential in order to maintain the number variation coefficient in the number particle size distribution at not more than 27 percent. In said suspension polymerization method, it is required to disperse polymerizable monomers into an aqueous medium so as to form oil droplets having the desired size of the toner. Namely, large oil droplets comprised of the polymerizable monomers are subjected to repeated mechanical shear employing a homogenizing mixer or a homogenizer so as to decrease the size to be approximately equal to toner particles. However, when such mechanical shearing method is employed, the number particle size distribution broadens. As a result, when the resulting particles are employed for the preparation of a toner, the particle size distribution of the resulting toner also broadens. Due to this, a classifying operation becomes essential.

Figure 3:
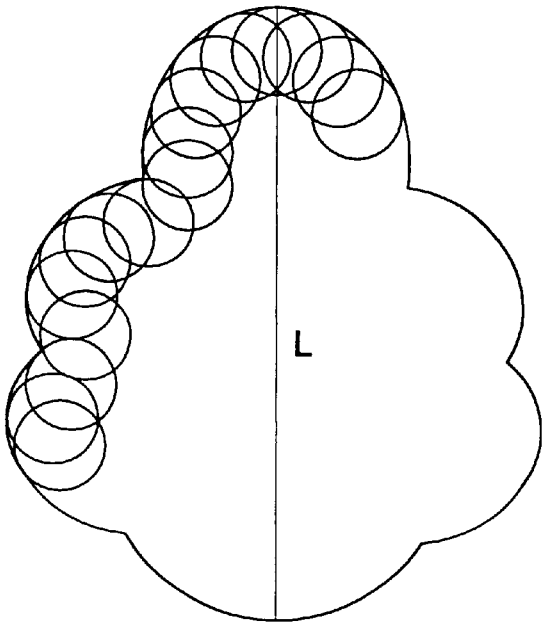
FIG. 3(*a*) to FIG. 3(*c*) are each a schematic view describing toner having no corners.
Figure 3:
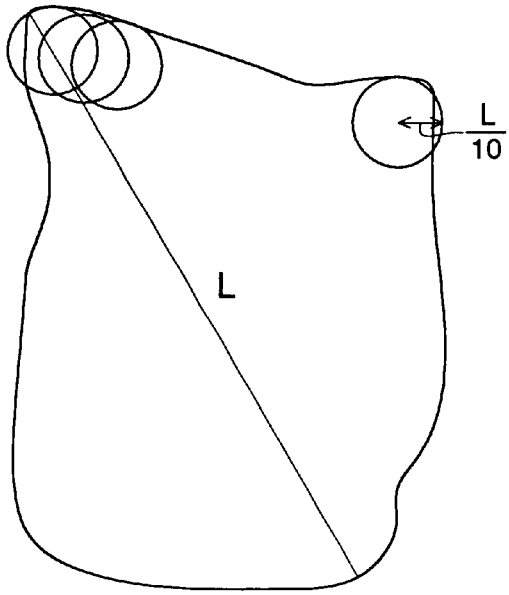
Figure 3:
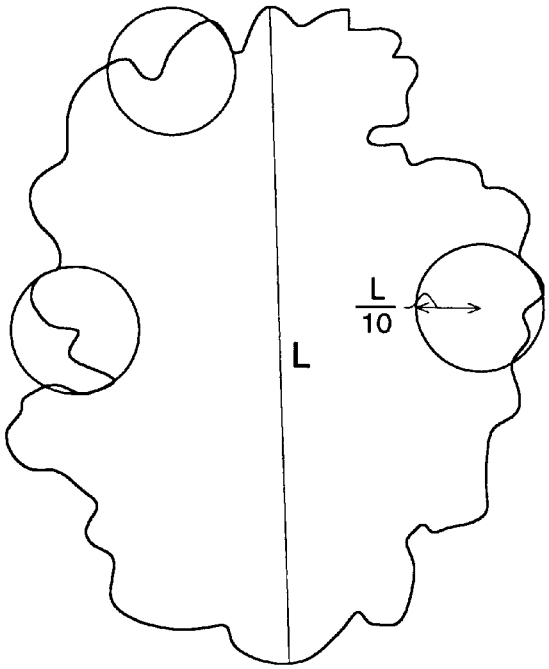

Toner particles having no corners, as described in the present invention, represent those which have substantially neither projected portions at which electric charges can concentrate nor which are readily abraded due to stress. Specifically, the toner particle described below is denoted as a toner having no corners. Namely, as shown in FIGS. 3(*a*), 3(*b*), and 3(*c*), when a circle having a radius of L/10, wherein L represents the longer diameter of a toner particle, is rolled within the circumferential edge of the toner particle while being in internal contact with the edge at one point, and when said circle does not substantially cross over the edge, said toner particle is denoted as a toner having no corners. Among the FIG. 3(*a*) to FIG. 3(*c*), FIG. 3(*a*) shows a toner particle having no corners, and FIG. 3(*b*) and FIG. 3(*c*) show the toner particles having corners. "When said toner does not substantially cross over the edge" means that there is not more than one of the projected portions at which said circle crosses over the edge. The longer diameter of the toner particle as described herein means the maximum distance of the particle when the projected image of the particle on a screen is placed between two parallel lines.

Said toner having no corners was measured as follows. First, a toner particle was magnified employing a scanning electron microscope and a photograph of said magnified particle was taken. The resulting photograph was further magnified to a magnification of 15,000 and a photographic image was obtained. Subsequently, employing the resulting photographic image, the presence of the above-mentioned corners was measured. Such measurement was carried out for 100 individual toner particles.

In the toner of the present invention, the ratio of toner particles having no corners is at least 50 percent by number, and is preferably at least 70 percent by number. By controlling the ratio of toner particles having no corners at no less than 50 percent by number, voids in transferred toner layers decrease to improve fixing property as well as to minimize offsetting. Further, the number of toner particles, which are readily abraded or broken down and which have portions at which charge can be concentrated, decrease. As a result, charge amount distribution narrows and chargeability is stabilized, enabling formation of excellent image quality over a long period of time.

Methods to prepare toner having no corners are not particularly limited. For example, as described above, as methods to control the shape coefficient, the toner having no corners may be prepared employing methods in which toner particles are sprayed into a heated air flow; in a gas phase, toner particles are subjected to application of repeated mechanical energy by impact force; or a toner is added to a solvent which does not dissolve the toner and is subjected to application of a circulating flow.

Furthermore, in a toner prepared employing the polymerization method in which the toner is prepared by associating or fusing resin particles, at the fusing terminating stage, the surface of a fused particle is highly rough and is not at all smooth. Toner having no corners is prepared by suitably controlling conditions such as the temperature, the rotational frequency of stirring blades, the stirring time, and the like, during the shape controlling process. These conditions may vary depending on the physical properties of resin particles. For example, the surface of toner smoothens by increasing the rotational frequency at a temperature higher than the glass transition point of said resin particles, and subsequently, a toner having no corners can be obtained.

The particle diameter of the toner of the present invention is preferably 3 to 8 $\mu$m in terms of number average particle diameter. When toner articles are prepared employing the polymerization method, the resulting particle diameter may be controlled based on the concentration of a coagulant, the addition amount of organic solvents, the fusing time, and further, the composition of the polymer itself.

By controlling the number average particle diameter between 3 to 8 $\mu$m, the number of fine toner particles having a large adhesive force, which jump and adhere onto a heating member to cause offsetting, decreases, and furthermore, the transfer efficiency is enhanced to improve halftone image quality, and also to improve fine line and dot image quality.

The toner of the present invention preferably has a sum M of at least 70 percent. Said sum M is obtained by adding relative frequency m1 of toner particles, included in the most frequent class, to relative frequency m2 of toner particles included in the second frequent class in a histogram showing the particle size distribution, which is drawn in such a manner that natural logarithm lnD is used as an abscissa, wherein D (in $\mu$m) represents the particle diameter of a toner particle, while being divided into a plurality of classes at intervals of 0.23, and the number of particles is used as an ordinate.

By maintaining the sum M of the relative frequency m1 and the relative frequency m2 at no less than 70 percent, the variance of the particle size distribution of toner particles narrows. As a result, by employing said toner in an image forming process, the minimization of generation of selective development may be secured.

In the present invention, the above-mentioned histogram showing the particle size distribution based on the number of particles is one in which natural logarithm lnD (wherein D represents the diameter of each particle) is divided at intervals of 0.23 into a plurality of classes (0 to 0.23, 0.23 to 0.46, 0.46 to 0.69, 0.69 to 0.92, 0.92 to 1.15, 1.15 to 1.38, 1.38 to 1.61, 1.61 to 1.84, 1,84 to 2.07, 2.07 to 2.30, 2.30 to 2.53, 2.53 to 2.76 . . . ), being based on the number of particles. Said histogram was prepared in such a manner that particle diameter data of a sample measured by a Coulter Multisizer according to conditions described below were transmitted to a computer via an I/O unit, so that in said computer, said histogram was prepared employing a particle size distribution analyzing program.

(Measurement Conditions)

Aperture: 100 $\mu$m

Sample preparation method: added to 50 to 100 ml of an electrolytic solution (ISOTON R-11, manufactured by Coulter Scientific Japan Co) is a suitable amount of a surface active agent (a neutral detergent) and stirred. Added to the resulting mixture is 10 to 20 mg of a sample to be measured. To prepare the sample, the resulting mixture is subjected to dispersion treatment for one minute employing an ultrasonic homogenizer.

Furthermore, the toner of the present invention may be advantageously employed when combined with external additives of fine particles, such as fine inorganic particles and fine organic particles. As the reason for such combining, it is assumed that burying and releasing of external additives may be effectively minimized, and its effect is markedly exhibited.

Preferably employed as such fine inorganic particles are inorganic oxide particles such as silica, titania, alumina, and the like. These fine inorganic particles are preferably subjected to hydrophobic treatment employing silan coupling agents, titanium coupling agents, and the like. The degree of the hydrophobic treatment is not particularly limited, however the degree is preferably between 40 and 95 measured as methanol wettability. The methanol wettability as described herein means the evaluation of wettability for methanol. In this method, 0.2 g of fine inorganic particles is weighed and added to 50 ml of distilled water placed in a 200 ml beaker. Methanol is slowly added dropwise while slowly stirring from a burette of which top is immersed in the solution until entire fine organic particles are wet. The degree of hydrophobicity is calculated from the formula given below:

$$\text{Degree of hydrophobicity}=a/(a+50)\times 100$$

wherein "a" (in ml) represents the amount of methanol required for making fine inorganic particles perfectly wet.

The added amount of said external additives is between 0.1 and 5.0 percent by weight of the toner, and is preferably between 0.5 and 4.0 percent by weight. As external additives, various materials may be employed in combination.

Several cases may be considered for application of the toner of the present invention, in which, for example, comprising magnetic materials, it is employed as a single component magnetic toner; mixed with a so-called carrier, it is employed as a two-component toner; or a non-magnetic toner is individually employed; and the like. Said toner may be suitably employed for all cases. However, in the present invention, mixed with the carrier, the toner is preferably employed as a two-component developer material.

Next, regarding values related to the present invention, values of a toner conventionally known will be described. These values may vary depending on production methods.

When a toner is prepared employing a pulverization method, the ratio of toner particles having a shape coefficient of 1.2 to 1.6 is approximately 60 percent by number. The variation coefficient of said shape coefficient is approximately 20 percent. Further, in the pulverization method, the particle diameter decreases under repeated pulverization. As a result, corner portions on the toner increase, and the ratio of toner particles having no corners is not more than 30 percent by number. Accordingly, when the preparation of a rounded toner having no corner portions is desired, while making toner particle of a uniform shape, as a method to control the shape coefficient, treatment to make a toner spherical employing heat and the like, as described above, becomes necessary. Further, the number variation coefficient in the number particle size distribution is approximately 30 percent when one classification operation is carried out after pulverization, and in order to control the number variation coefficient below 27 percent, it is required to repeat the classification operation.

When toner is prepared employing a suspension polymerization method, conventionally, the polymerization is carried out in a laminar flow, resulting in toner particles having a nearly spherical shape. For example, in the toner described in Japanese Patent Publication Open to Public Inspection No. 56-130762, the ratio of toner particles having a shape coefficient of 1.2 to 1.6 is approximately 20 percent by number, and the variation coefficient of the shape coefficient is approximately 18 percent, while the ratio of toner particle have no corners is approximately 85 percent by number. Furthermore, as previously described in the method which controls a number variation coefficient in the number particle size distribution, large oil droplets comprised of polymerizable monomers are subjected to repeated mechanical shearing to reduce the size of the droplets to nearly a similar size as the desired toner particles. Therefore, the distribution of oil droplet diameter is broadened. As a result, the particle size distribution of the resulting toner widens. Therefore, in order to decrease the number variation coefficient, a classification operation is required.

When toner is prepared employing the polymerization method in which resin particles are associated or fused, for example, toner described in Japanese Patent Publication Open to Public Inspection No. 63-186253 comprises approximately 60 percent by number of toner particles having a shape coefficient of 1.2 to 1.6, its variation coefficient of the shape coefficient is approximately 18 percent and further, its ratio of toner particles having no corners is approximately 44 percent by number. Still further, the particle size distribution of said toner is wide and the number variation coefficient is 30 percent. Accordingly, in order to decrease the number variation coefficient, a classification operation is required.

Development methods in which the toner of the present invention may be employed are not particularly limited. However, because the charge amount distribution of the toner of the present invention is narrow, charge variation is minimized to make it possible to secure a uniform charge amount. As a result, in a non-contact development method, it is possible to form uniform images over a longer period of time.

The non-contact development method as described herein means that a developer material layer, formed on a developer material holding member is not brought into contact with a photoreceptor. In order to realize said development method, the developer material layer is preferably composed of a thin layer. In said method, a 20 to 500 μm thick developer material layer is formed in the development area on the surface of the developer material holding member, and the gap between the photoreceptor and the developer material holding member is greater than said developer material layer. Such a thin layer is formed employing methods in which a magnetic blade, utilizing a magnetic force, is employed, a developer material layer regulating rod is brought into pressure contact with the surface of the developer material holding member, and the like. Further methods are those in which a urethane blade, a phosphor bronze plate, and the like are brought into contact with the surface of the developer material holding member to regulate the developer material layer. The pressure on the regulating member is suitably between 1 and 15 gf/mm. When said pressure is small, conveyance is not stabilized due to the absence of a sufficient regulating force, while when said pressure is large, the durability of the developer material tends to decrease due to the increase in stress on the developer material. The preferred range is between 3 and 10 gf/mm. It is desirable that the gap between the developer material holding member and the surface of the photoreceptor is greater than that of the developer material layer. Further, when bias is applied during development, either method may be employed in which only a direct current component is applied, or an alternative current bias is applied.

In the present invention, an alternating electric field is applied to the gap between said developer material holding member and the electrostatic latent image holding member. By applying said alternating electric field, it is possible to allow toner to effectively jump. Conditions of said alternating electric field are those in which the alternative current frequency "f" is preferably between 200 and 8,000 Hz, and an alternative current voltage Vpp is preferably between 500 and 3,000 V. When said alternating electric field is employed, it is desirable that toner possesses uniform chargeability. Namely, when the chargeability exhibits distribution among toners, an effect to pull back weakly chargeable toner employing the alternating electric field is offset, and as a result, an image quality improving effect is deteriorated.

Employed as the developer material holding members employed in the present invention are many of those which have a built-in magnet, and the developer material is conveyed into a development zone by the rotation of the surface (sleeve) of said developer material holding member. Employed as materials constituting the sleeve are those made of aluminum, aluminum of which the surface was subjected to oxidation treatment or stainless steel.

An appropriately sized developer material holding members are those having a diameter of 10 to 40 mm are employed. When the diameter is less than the lower limit, the developer material is not well mixed, resulting insufficient mixing which carries out insufficient charge application to toner. When the diameter is greater than the upper limit, the centrifugal force against the developer material increase, and a problem with toner scattering tends to occur.

When the toner of the present invention is employed in the non-contact development method, it is preferably employed as a two-component developer material while mixing with the carrier.

Employed as carriers constituting the two-component developer material, may be materials which are conventionally known in the art, such as metals, e.g., iron, ferrite, magnetite, and the like, and alloys of said metals with metals such as aluminum, lead, and the like, as magnetic particles. Specifically, ferrite particles are preferred. The volume average particle diameter of said magnetic particles is preferably between 15 and 100 μm, and is more preferably between 25 and 60 μm. The volume average particle diameter of carrier may be measured employing a laser diffraction type particle size distribution measuring device, "HELOS" (manufactured by SYNPATEC Co.) equipped with a wet-type homogenizer as a representative device.

Preferred carriers are those which are further coated with a resin or a so-called resin-dispersed type carrier prepared by dispersing magnetic particles into a resin. Resin compositions for coating are not particularly limited. For example, employed may be olefin based resins, styrene based resins, styrene/acryl based resins, silicone based resins, ester based resins, fluorine containing polymer based resins, and the like. Furthermore, resins to constitute the resin-dispersed type carrier are also not particularly limited, and those known in the art may be employed. For example, employed may be styrene acrylic resins, polyester resins, fluorine based resins, phenol resins, and the like.

One example of the non-contact development method will be explained with reference to FIG. 4 below.

Figure 4:
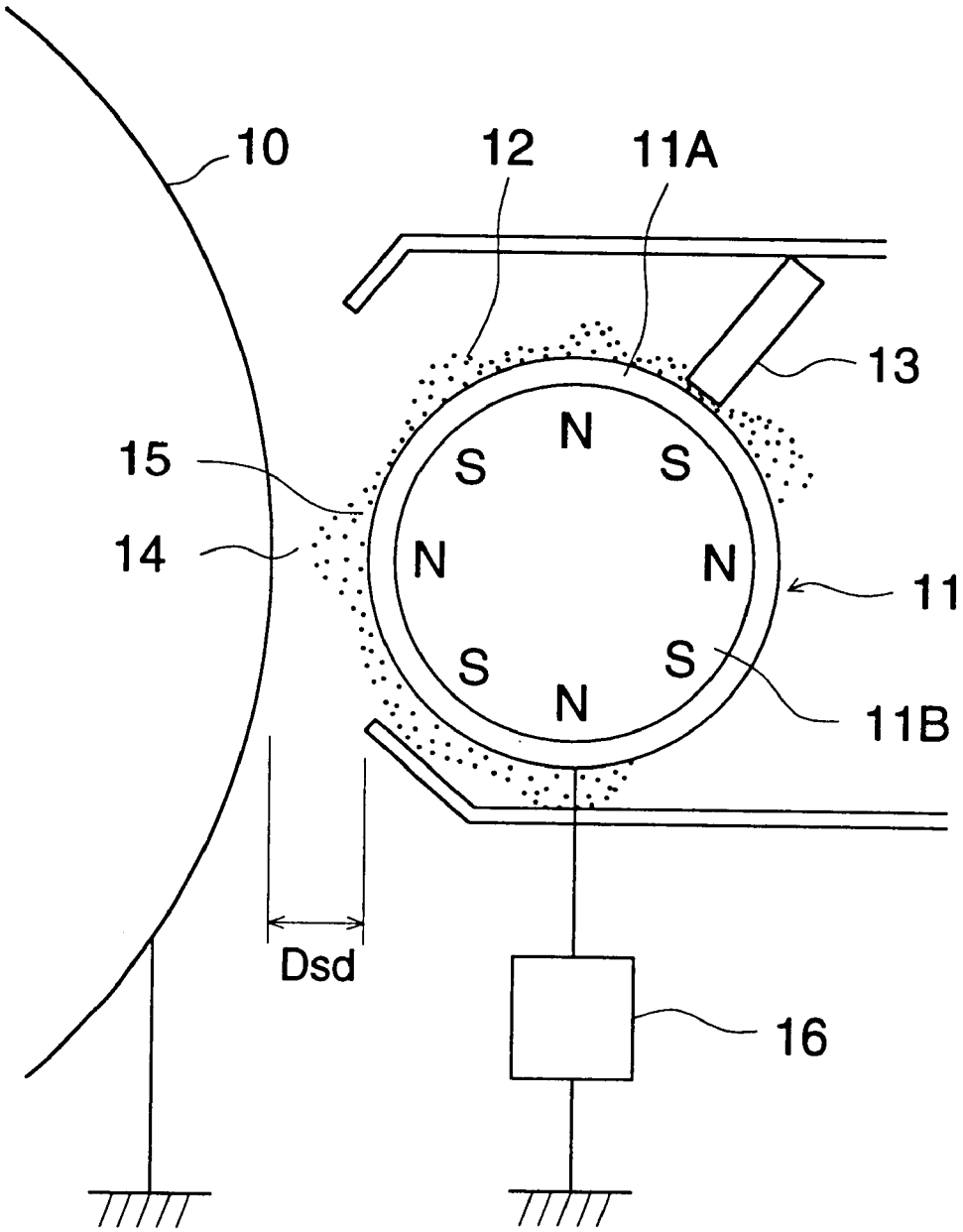
FIG. 4 is a cross-sectional view of a development unit.

FIG. 4 is a schematic view of the development section of the non-contact development method which may be appropriately employed for the image forming method of the present invention. Reference numeral 10 is a photoreceptor, 11 is a developer material holding member, 12 is a two-component developer material comprising the toner of the present invention, 13 is a developer material layer regulating member, 14 is a development zone, 15 is a developer material layer, and 16 is a power source to form an alternating electric field.

The two-component developer material comprising the toner of the present invention is held on the developer material holding member 11 housing magnet 11B in its interior to provide a magnetic force, and is conveyed to the development zone 14 by the movement of sleeve 11A. During this conveyance, the thickness of the developer material layer 15 is regulated in the development zone 14 employing the developer material layer regulating member 13 to prevent contact with the photoreceptor 10.

The minimum gap (Dsd) in the development zone 14 is greater than the thickness of the developer material layer (preferably conveyed as an approximately 50 to 300 μm thick layer), and is, for example, between about 100 and about 1,000 μm (preferably between 100 and 500 μm).

Power source 16 is one which forms an alternating electric field, and an alternative current having a frequency of 200 to 8,000 Hz and a voltage of 500 to 3,000 Vp-p is preferred. Said power source may be of such a constitution in that a direct current is added to an alternative current in series, if desired. In such a case, the direct current voltage is preferably between 300 and 800 V.

Furthermore, when the toner of the present invention is employed in the non-contact development method, the layer thickness of the developer material comprising the toner of the present invention is preferably between 0.1 and 8 mm in the development zone, and is more preferably between 0.4 and 5 mm. Further the gap between the photoreceptor and the developer material holding member is preferably between 0.15 and 7 mm, and is more preferably between 0.2 and 4 mm.

Listed as one of the suitable fixing methods employed in the present invention may be a so-called contact heating method. Specifically listed as contact heating methods may be a thermal pressure method, a heated roll fixing method, and a pressure contact thermal fixing method in which fixation is carried out employing a rotating pressing body comprising a fixed heating member in its interior.

In the heated roll fixing method, employed are, in many cases, an upper roller housing in its interior a metal cylinder as a heat source, which is comprised of iron, aluminum, or the like of which surface is coated with tetrafluoroethylene, polytetrafluoroethylene-perfluoroalkoxyvinyl ether copolymer, or the like, and a lower roller formed of silicone rubber or the like. The representative example of the heat source is one comprising a line heater, which raises the temperature of the surface of the upper roller from about 120 to about 200° C. In a fixing section, pressure is applied between the upper roller and the lower roller to deform the lower roller and to form a so-called nip. The width of said nip is generally between 1 and 10 mm, and is preferably between 1.5 and 7 mm. The fixing line speed is preferably between 40 and 600 mm/second. When the nip width is narrow, heat cannot be uniformly applied to toner, resulting in uneven fixing. On the other hand, when the nip width is wider, fusing of the resin is accelerated, and a problem with excessive offsetting occurs.

A fixing cleaning mechanism may be provided and employed. Employed as such a method may be one in which silicone oil is fed onto the fixing roller or film, or alternatively cleaning may be carried out employing a pad, a roller, a web, or the like impregnated with silicone oil.

Next, the method in which fixing is carried out employing a rotating press member which includes a fixed heating body, employed in the present invention, will be described.

Said fixing method is a pressure contact heat-fixing method employing a pressing member which is brought into face-to-face pressure contact with a fixed heating body and brings a recording material into close contact with the heating body via a film.

Said pressure contact heat-fixing device comprises a heating body which has smaller heat capacity compared to conventional heating rollers, and has a line-shaped heating section perpendicular to the conveying direction of the recording material. The maximum temperature of the heating section is generally between 100 and 300° C.

Further, the pressure contact heat-fixing as described herein is a method in which a toner image which is not yet fixed is brought into pressure contact with a heating source to accomplish fixing, in such methods which are commonly and frequently employed, a recording material holding, a toner image which has not yet fixed, is conveyed between the heating member and the pressing member, and the like. According to such a method, heating is rapidly carried out, and as a result, it is possible to accomplish high speed fixing. However, it is difficult to control temperature, and toner adheres and remains on the portion with which toner, which has not yet fixed, on the surface portion of the heat source is brought into pressure contact. As a result, troubles tend to occur in which offsetting is likely to occur and sheets of recording material are wound on the fixing device, and the like.

In this fixing method, the low-heat capacity linear heating body with fixed in the device is prepared by coating a resistance material onto an aluminum substrate having preferably a thickness of 0.2 to 5.0 mm, and more preferably 0.5 to 3.5 mm, a width of 10 to 15 mm, a longitudinal length of 240 to 400 mm, and an electric current being provided to both ends of the linear heating body.

The electric current has a DC 100 V with a pulse waveform of a 20 millisecond cycle and is supplied upon varying to the pulse width in response to the emission amount of heat energy controlled by a temperature sensor. In the low-heat capacity linear heating body, temperature measured by the temperature sensor is denoted as T1, while when the surface temperature of film faced against a resistance material is denoted as T2, T2 becomes lower than T1. Herein, T1 is preferably between 120 and 220° C., and T2 is preferably 0.5 to 10° C. lower than T1. Furthermore, when the surface temperature of a film material at a portion at which the film is peeled from the toner surface is denoted as T3, T3 is nearly equal to T2. The film is then brought into contact with the heating body, which is energy controlled and temperature controlled as described above, and is conveyed in the direction of the central arrow in FIG. 5(*a*) described below.

Employed as film for fixing are such as endless film belts, composed of 10 to 35 $\mu$m thick heat resistant film such as polyester, polyperfluoroalkoxyvinyl ether, polyimide, polyetherimide, and the like, which is in many cases coated with a 5 to 15 $\mu$m thick releasing agent layer prepared by adding an electrically conductive material to a fluorine resin such as Teflon and the like.

The film is subjected to driving force and tension employing a driving roller and a driven roller, and is then conveyed in the arrow direction without allowing wrinkling nor slippage. The line speed in the fixing device is preferably between 40 and 600 mm/second.

Pressure rollers comprise a rubber elastic layer with high releasing properties, which is comprised of silicone rubber and the like, is brought into pressure of 2 to 30 kg contact with a heating body via a film material, and is rotated under pressure contact.

Figure 5:
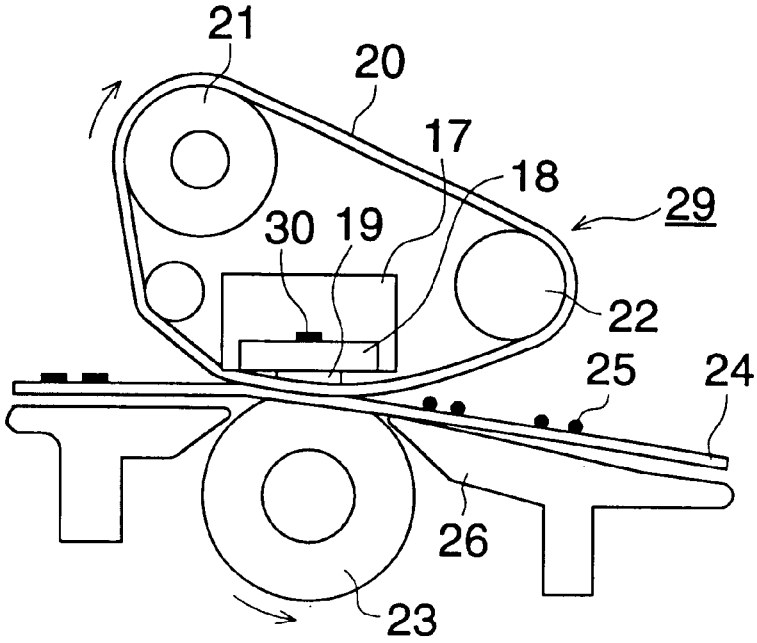
FIG. 5(*a*) and FIG. 5(*b*) are each a cross-sectional view of a structure showing an example of a fixing unit.
Figure 5:
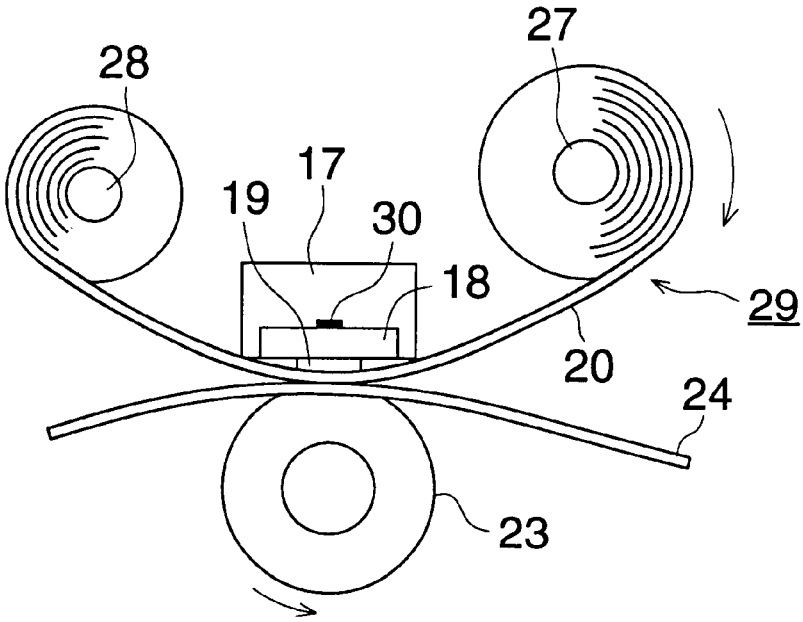

Furthermore, the above-mentioned example is described in which an endless film belt is employed. However, as shown in FIG. 5(*b*), a film sheet may be used employing a film sheet feeding shaft and a winding shaft. Further, a simple cylindrical one may be employed, which has no a driving roller, or the like, in its interior.

The above-mentioned fixing device may employ a cleaning mechanism. Employed as said cleaning methods are those in which various silicone oils are fed to a film for fixing, and cleaning is carried out employing a pad, a roller, a web, and the like in which silicone oil is impregnated.

Further, employed as silicone oils may be polydimethylsiloxane, polymethylphenylsiloxane, polydiphenylsiloxane, and the like. Further, siloxanes comprising fluorine may also be suitably employed.

Next, FIG. 5 shows an example of the cross-sectional view of the constitution of said fixing device 29.

In FIG. 5(*a*), reference numeral 17 is a low-heat capacity linear heating body which is fixed in the device. One example is prepared by coating a 1.0 mm width resistance material 19 onto an alumina substrate 18 having a height of 1.0 mm, a width of 10 mm, and a longitudinal length of 240 mm, and an electric current is supplied to both ends in the longitudinal direction.

The electric current having, for example, DC 100 V with a 20 millisecond pulse waveform of a cycle of is supplied, and a specific temperature is controlled employing signals from temperature detecting element 30 and maintained at a specified temperature. Owing to that, the pulse width varies in response to an emission amount of energy, at a range of, for example, between 0.5 and 5 milliseconds.

Recording material 24, holding unfixed toner image 25, is brought into contact with a heating body controlled as described above via moving film 20 to thermally fix the toner.

The film employed herein is subjected to tension employing driving roller 21 and driven roller 22, and conveyed without the formation of wrinkling. Reference numeral 23 is a pressure roller comprising a rubber elastic layer formed of silicone rubber and the like, which presses the heating body via film under a total pressure of 4 to 20 kg. The toner image 25, which has not been fixed, on the recording material 24, is lead to a fixing section employing inlet guide 26, and is heated as described above, resulting in a fixed image.

In the above, description is made employing an endless belt. However, as shown in FIG. 5(*b*), a sheet of film may also be employed utilizing film sheet feeding shaft 27 and a winging shaft 28.

EXAMPLES (Toner Production Example 1: Example of an Emulsion Polymerization Association Method)

Added to 10.0 liters of pure water was 0.90 kg of sodium dodecylsulfate, which was dissolved while stirring. Slowly added to the resulting solution was 1.20 kg of Regal 330R (carbon black, manufactured by Cabot Co.), and the resulting mixture was thoroughly stirred for one hour, and thereafter, was continually dispersed for 20 hours employing a sand grinder (a medium type homogenizer). The resulting dispersion was denoted as "Colored Dispersion 1". A solution comprised of 0.055 kg of sodium dodecylbenzenesulfonate and 4.0 liters of deionized water is denoted as "Anionic Surface Active Agent Solution A".

A solution comprised of 0.014 kg of nonylphenolpolyethylene oxide 10-mole addition product and 4.0 liters of deionized water is labeled as "Nonionic Surface Active Agent Solution B", while A solution prepared by dissolving 223.8 g of potassium persulfate in 12.0 liters of deionized water is labeled as "Initiating Solution C".

Added to 100 liters of a GL (glass lining) reaction vessel equipped with a temperature sensor, a cooling pipe, and a nitrogen gas introducing unit were 3.41 kg of WAX emulsion (polypropylene emulsion having a number average molecular weight of 3,000, and having a number average primary particle diameter of 120 nm/a solid portion concentration of 29.9 percent), all of "Anionic Surface Active Agent A", and all of "Nonionic surface Active Agent Solution B", and the resulting mixture was stirred. Subsequently, 44.0 liters of deionized water were added.

The resulting mixture was heated and when it reached 75° C., all of "Initiator Solution C" was added dropwise. Thereafter, while controlling the temperature at 75±1° C., 12.1 kg of styrene, 2.88 kg of n-butyl acrylate, 1.04 kg of methacrylic acid, and 548 g of t-dodecylmercaptan were added dropwise. After completing of dropwise addition, the resulting mixture was heated to 80±1° C., and stirred for 6 hours while maintaining said temperature. Subsequently, the mixture was cooled below 40° C. and stirring was terminated. Filtration was then carried out employing a pole filter and the resulting filtrate was labeled as "Latex 1-A".

Further, the resin particles in Latex 1-A had a glass transition temperature of 57° C., a softening point of 121° C., and regarding the molecular weight distribution, a weight average molecular weight of 12,700 and a weight average particle diameter of 120 nm.

Furthermore, a solution prepared by dissolving 0.055 kg of sodium dodecylbenezensulfonate in 4.0 liters of deionized water was designated as "Anionic Surface Active Agent solution D", while a solution prepared by dissolving 0.014 kg of nonylphenolpolyethylene oxide 10-mole addition product in 4.0 liters of deionized water was denoted as "Nonionic Surface Active Agent E".

A solution prepared by dissolving 200.7 g of potassium persulfate (manufactured by Kanto Kagaku Co.) in 12.0 liters of deionized water was labeled as "Initiator Solution F".

Added to 100 liters of a GL reaction vessel equipped with a temperature sensor, a cooling pipe, a nitrogen gas introducing unit, and a comb-shaped baffle, were 3.41 kg of WAX emulsion (polypropylene emulsion having a number average molecular weight of 3,000, having a number average primary particle diameter of 120 nm and a solid portion concentration of 29.9 percent), all of "Anionic Surface Active Agent D", and all of "Nonionic Surface Active Agent Solution E", and the resulting mixture was stirred. Subsequently, 44.0 liters of deionized water were added. The resulting mixture was heated and when heated to 70° C., "Initiator Solution F" was added. Thereafter, 11.1 kg of styrene, 4.00 kg of n-butyl acrylate, 1.04 kg of methacrylic acid, and 9.02 g of t-dodecylmercaptan were previously mixed and added dropwise. After completing of dropwise addition, the resulting mixture was controlled to 72±2° C., and stirred for 6 hours. Further, after being heated to 72±2° C., stirring was continued for 12 hours while maintaining said temperature. Subsequently, the temperature was lowered below 40° C. and stirring was terminated. Filtration was then carried out employing a pole filter and the resulting filtrate was labeled as "Latex 1-B".

Further, it was found that the resin particles in Latex 1-B had a glass transition temperature of 58° C., a softening point of 132° C., and regarding the molecular weight distribution, a weight average molecular weight of 245,000 and a weight average particle diameter of 110 nm.

A solution prepared by dissolving 5.36 kg of sodium chloride in 20.0 liters of deionized water was labeled as "Sodium Chloride Solution G".

A solution prepared by dissolving 1.00 g of a fluorine based nonionic surface active agent in 1 l of deionized water was labeled as "Nonionic Surface Active Agent Solution H".

Added to a stainless steel reaction vessel (with constitution of the stirrer blades having the angle of the blade of 25° as shown in FIG. 1(*i*)) equipped with a temperature sensor, a cooling pipe, a nitrogen gas introducing unit, a monitoring unit for the particle diameter and shape, were 20.0 kg of Latex 1-A, 5.2 kg of Latex 1-B, and 0.4 kg of dispersion of colorant, which were prepared as described above, and 20.0 kg of deionized water, and the resulting mixture was stirred. Subsequently the mixture was heated to 40° C., and Sodium Chloride Solution G, 6.00 kg of isopropanol (manufactured by Kanto Kagaku Co.), and Nonionic Surface Active Agent Solution H were added in that order. Thereafter, after the resulting mixture was left for 10 minutes, it was heated to 85° C. over 60 minutes. While maintaining the temperature at 85±2° C. while stirring, salting out/fusion were carried out to increase the particle diameter. Next, 2.2 liters of deionized water were added to terminate the growth of the particle diameter.

Added to reaction vessel 5 liters (with the constitution of the stirrer blades as shown in FIG. 1(*i*)) equipped with a temperature sensor, a cooling pipe, and a monitoring unit for the particle diameter and shape were 5.0 kg of fused particle dispersion prepared as described above, and at 85±2° C., the dispersion was stirred for 0.5 to 15 hours to control the particle shape. Thereafter, the resulting dispersion was cooled below 40° C., and stirring was stopped. Subsequently, employing a centrifuge, classification was carried out of the liquid employing a centrifugal sedimentation method. The resulting liquid was filtered employing a sieve having a sieve opening of 45 μm, and the filtrate was labeled as Association Liquid 1. Subsequently, employing a glass filter, non-spherical particles in a wet cake were collected from Association Liquid 1 employing filtration. Thereafter, those particles were washed with deionized water.

The resulting non-spherical particles were dried at an intake air temperature of 60° C. employing a flash jet dryer, and were then dried at 60° C. employing a fluid layer dryer. Externally mixed with 100 weight parts of the prepared colored particles was one weight part of fine silica particles employing a Henschel mixer to obtain the toner employing the emulsion polymerization method.

Toners 1 through 50 were prepared in such a manner that during the above-mentioned salting out/fusion stage and monitoring of the shape controlling process, by controlling the stirrer rotation frequency as well as the heating time, the shape as well as the variation coefficient of the shape coefficient was controlled, and further, employing classification in the liquid, the particle diameter as well as the variation coefficient of the particle size distribution was optionally regulated.

(Toner Production Example 2: Example of an Emulsion Polymerization Association Method)

Toners 51 through 59, shown in Table 1, were prepared in the same manner as Toner Production Example 1, except that the carbon black was replaced with 1.05 kg of benzidine based yellow pigments as colorants.

(Toner Production Example 3: Example of an Emulsion Polymerization Association Method)

Toners 60 through 68, shown in Table 1, were prepared in the same manner as Toner Production Example 1, except that the carbon black was replaced with 1.20 kg of quinacridone based magenta pigments as colorants.

(Toner Production Example 4: Example of an Emulsion Polymerization Association Method)

Toners 69 through 77, shown in Table 1, were prepared in the same manner as Toner Production Example 1, except that the carbon black was replaced with 0.60 kg of phthalocyanine based magenta pigments as colorants.

(Toner Production Example 5: Example of a Suspension Polymerization Method)

A mixture comprised of 165 g of styrene, 35 g of n-butyl acrylate, 10 g of carbon black, 2 g of a di-t-butyl salicylic acid metal compound, 8 g of a styrene-methacrylic acid copolymer, and 20 g of paraffin wax (having a melting point of 70° C.) were heated to 60° C., and uniformly dissolve dispersed employing a TK homomixer (manufactured by Tokushu Kika Kogyo Co.). Then, 10 g of 2,2'-azobis(2,4-valeronitrile) were added and dissolved, and a polymerizable monomer composition was prepared. Subsequently, 710 g of deionized water and 450 g of 1M aqueous sodium phosphate solution were added, and 68 g of 1.0 M calcium chloride was gradually added to the resulting mixture while stirring at 13,000 rpm employing a TK homomixer, and a suspension, in which tricalcium phosphate had been dispersed, was prepared. The above-mentioned polymerizable monomer composition was added to the resulting suspension, and the resulting mixture was stirred at 10,000 rpm for 20 minutes employing a TK homomixer to granulate the polymerizable monomer composition. Thereafter, employing a reaction apparatus equipped with stirring blades constituted as shown FIG. 1(*b*), the resulting particles underwent reaction at 75 to 95° C. for 5 to 15 hours. Tricalcium phosphate was dissolved and removed employing hydrochloric acid. Next, employing a centrifuge, classification was carried out utilizing a centrifugal sedimentation method, and filtration, washing, and drying were carried out. Toner prepared employing the suspension polymerization method was then obtained by externally adding one weight part of fine silica particles to 100 weight parts of the obtained colored particles.

During the above-mentioned polymerization, monitoring was carried out, and by controlling the liquid temperature, the stirrer rotation frequency, and the heating time, the shape as well as the variation coefficient of the shape coefficient was controlled. Further, by employing the classification in liquid, the particle diameter as well as the variation coefficient of the particle size distribution was optionally adjusted. Thus, toners 78 through 83, shown in table 1, were prepared.

(Toner Production Example 6: Example of a Suspension Polymerization Method)

Toner 84, shown in Table 1, was prepared in the same manner as Toner Production Example 5, except that the constitution of the stirrer blades was replaced with that of FIG. 1(*i*) and the classification in liquid employing a centrifuge was eliminated.

(Toner Production Example 7: Example of a Pulverization Method)

Toner raw materials comprised of 100 kg of a styrene-n-butyl acrylate copolymer resin, 10 kg of carbon black, and 4 weight parts of polypropylene were preliminary mixed employing a Henschel mixer, and the resulting mixture was fuse-kneaded employing a biaxial extruder, preliminary pulverized employing a hammer mill, and further pulverized employing a jet method pulverizing unit. The resulting powder was dispersed (for 0.05 second at 200 to 300° C.) into the heated air flow of a spray drier to obtain shape adjusted particles. The resulting particles were repeatedly classified employing a forced air classifying unit until the targeted particle diameter distribution was obtained. Externally added to 100 weight parts of the obtained colored particles was one part of fine silica particles and mixed employing a Henschel mixer. Thus toner, prepared employing the pulverization method, was obtained.

As described above, the shape as well as the variation coefficient of the shape coefficient was controlled, and further, the particle diameter as well as the variation coefficient of the particle size distribution was adjusted. Thus toners 85 through 88 shown in Table 1 were prepared.

TABLE 1

| Toner Number | Color | Ratio of Shape Coefficient of 1.0 to 1.6 (%) | Ratio of Shape Coefficient of 1.2 to 1.6 (%) | Variation Coefficient of Shape Coefficient (%) | Ratio of Toner Particles having no Corners (%) | Number Average Particle Diameter (μm) | Variation Coefficient of Number Distribution (%) | Sum M (%) of m1 and m2 |
|---|---|---|---|---|---|---|---|---|
| Toner 1 | black | 64.1 | 62.0 | 14.9 | 43 | 2.4 | 26.2 | 68.0 |
| Toner 2 | black | 62.7 | 60.6 | 17.3 | 58 | 2.3 | 25.8 | 68.1 |
| Toner 3 | black | 91.3 | 67.9 | 15.3 | 43 | 2.2 | 28.4 | 65.2 |
| Toner 4 | black | 63.4 | 61.6 | 15.7 | 42 | 3.2 | 26.1 | 68.3 |
| Toner 5 | black | 63.7 | 60.5 | 18.2 | 57 | 3.4 | 26.5 | 67.4 |
| Toner 6 | black | 92.2 | 68.2 | 15.2 | 41 | 3.3 | 28.6 | 64.8 |
| Toner 7 | black | 82.5 | 68.3 | 15.2 | 88 | 5.6 | 25.9 | 80.7 |
| Toner 8 | black | 91.2 | 73.2 | 12.1 | 94 | 5.7 | 20.7 | 82.3 |
| Toner 9 | black | 68.1 | 64.0 | 15.0 | 40 | 5.6 | 26.6 | 67.4 |
| Toner 10 | black | 91.2 | 67.7 | 15.1 | 42 | 5.7 | 26.0 | 68.9 |
| Toner 11 | black | 78.9 | 68.1 | 16.9 | 88 | 5.7 | 22.0 | 79.8 |
| Toner 12 | black | 67.8 | 64.0 | 17.7 | 55 | 5.5 | 26.1 | 68.0 |
| Toner 13 | black | 78.2 | 67.7 | 16.8 | 53 | 5.6 | 26.2 | 68.2 |
| Toner 14 | black | 94.6 | 74.1 | 12.4 | 89 | 5.7 | 27.8 | 71.6 |
| Toner 15 | black | 89.4 | 66.7 | 15.1 | 54 | 5.5 | 28.8 | 64.7 |
| Toner 16 | black | 62.3 | 60.7 | 15.1 | 40 | 7.7 | 26.0 | 68.2 |
| Toner 17 | black | 63.5 | 60.2 | 17.2 | 53 | 7.7 | 26.3 | 67.8 |
| Toner 18 | black | 89.6 | 66.8 | 15.5 | 42 | 7.6 | 28.5 | 65.1 |
| Toner 19 | black | 67.5 | 64.2 | 15.3 | 41 | 8.7 | 26.1 | 68.2 |
| Toner 20 | black | 72.3 | 64.1 | 14.9 | 43 | 8.7 | 26.5 | 67.9 |
| Toner 21 | black | 66.8 | 63.9 | 15.2 | 54 | 8.8 | 26.1 | 68.1 |
| Toner 22 | black | 67.4 | 63.8 | 15.3 | 42 | 8.9 | 25.7 | 74.5 |
| Toner 23 | black | 92.4 | 68.3 | 14.9 | 43 | 8.7 | 26.2 | 68.6 |
| Toner 24 | black | 93.1 | 73.2 | 14.7 | 40 | 8.7 | 26.4 | 67.8 |
| Toner 25 | black | 90.7 | 67.6 | 15.0 | 56 | 8.8 | 26.0 | 68.4 |
| Toner 26 | black | 91.6 | 68.0 | 14.9 | 41 | 8.6 | 25.8 | 73.8 |
| Toner 27 | black | 62.1 | 60.3 | 16.7 | 74 | 8.7 | 26.5 | 67.9 |
| Toner 28 | black | 64.2 | 62.0 | 15.6 | 42 | 8.7 | 26.8 | 67.0 |
| Toner 29 | black | 63.7 | 61.9 | 13.4 | 43 | 8.9 | 26.5 | 67.6 |
| Toner 30 | black | 63.2 | 61.4 | 15.1 | 42 | 9.0 | 24.2 | 69.3 |
| Toner 31 | black | 68.4 | 63.9 | 17.0 | 52 | 8.7 | 26.2 | 68.1 |
| Toner 32 | black | 73.0 | 64.3 | 16.8 | 54 | 8.9 | 26.7 | 67.8 |
| Toner 33 | black | 67.5 | 63.8 | 17.4 | 53 | 8.7 | 25.7 | 76.1 |
| Toner 34 | black | 88.5 | 66.9 | 18.1 | 56 | 8.8 | 26.2 | 68.0 |
| Toner 35 | black | 87.4 | 72.3 | 17.2 | 58 | 8.9 | 26.7 | 67.9 |
| Toner 36 | black | 89.1 | 67.4 | 17.6 | 56 | 9.1 | 25.6 | 76.3 |
| Toner 37 | black | 63.9 | 62.0 | 17.4 | 53 | 8.8 | 25.9 | 68.5 |
| Toner 38 | black | 63.0 | 60.8 | 17.3 | 54 | 8.6 | 23.5 | 69.1 |
| Toner 39 | black | 63.9 | 61.7 | 16.9 | 77 | 8.7 | 26.1 | 68.3 |
| Toner 40 | black | 92.5 | 68.3 | 14.9 | 56 | 8.8 | 27.9 | 65.3 |
| Toner 41 | black | 90.3 | 68.1 | 14.8 | 76 | 8.9 | 28.0 | 65.4 |
| Toner 42 | black | 90.0 | 67.4 | 15.0 | 55 | 9.1 | 27.8 | 73.8 |
| Toner 43 | black | 89.5 | 66.7 | 15.1 | 40 | 8.7 | 28.7 | 64.8 |
| Toner 44 | black | 90.6 | 67.3 | 13.3 | 44 | 8.8 | 29.0 | 64.8 |
| Toner 45 | black | 95.2 | 73.7 | 14.7 | 40 | 8.8 | 28.3 | 65.1 |
| Toner 46 | black | 63.6 | 62.1 | 15.3 | 42 | 8.7 | 28.4 | 64.7 |
| Toner 47 | black | 62.8 | 60.5 | 17.8 | 42 | 8.8 | 26.2 | 68.3 |
| Toner 48 | black | 63.7 | 61.1 | 17.6 | 57 | 8.8 | 28.3 | 65.6 |
| Toner 49 | black | 87.6 | 67.6 | 17.9 | 44 | 8.8 | 28.2 | 64.6 |
| Toner 50 | black | 63.8 | 61.5 | 18.0 | 44 | 8.8 | 28.4 | 65.3 |
| Toner 51 | yellow | 88.4 | 74.4 | 12.4 | 93 | 5.8 | 21.3 | 83.1 |
| Toner 52 | yellow | 63.9 | 62.2 | 15.5 | 41 | 8.6 | 26.7 | 67.9 |
| Toner 53 | yellow | 62.8 | 60.7 | 17.7 | 56 | 9.0 | 26.0 | 68.2 |
| Toner 54 | yellow | 92.1 | 68.0 | 14.9 | 44 | 8.6 | 28.6 | 65.3 |
| Toner 55 | yellow | 64.1 | 62.7 | 15.6 | 40 | 9.1 | 28.5 | 65.3 |
| Toner 56 | yellow | 62.9 | 60.6 | 18.1 | 40 | 8.6 | 26.5 | 67.9 |
| Toner 57 | yellow | 63.5 | 60.8 | 18.0 | 58 | 8.8 | 28.1 | 64.7 |
| Toner 58 | yellow | 88.4 | 68.7 | 18.1 | 42 | 8.7 | 28.6 | 65.0 |
| Toner 59 | yellow | 63.2 | 61.1 | 17.8 | 41 | 8.8 | 27.9 | 65.1 |
| Toner 60 | magenta | 90.3 | 74.1 | 13.1 | 95 | 5.6 | 20.8 | 83.4 |
| Toner 61 | magenta | 62.8 | 60.6 | 15.2 | 42 | 8.7 | 26.2 | 68.1 |
| Toner 62 | magenta | 63.4 | 61.2 | 17.1 | 57 | 8.7 | 26.4 | 67.8 |
| Toner 63 | magenta | 90.4 | 67.8 | 14.8 | 41 | 8.8 | 28.8 | 64.6 |
| Toner 64 | magenta | 63.9 | 62.4 | 15.1 | 41 | 8.9 | 27.9 | 65.0 |
| Toner 65 | magenta | 63.3 | 61.5 | 17.9 | 42 | 8.7 | 25.9 | 68.1 |
| Toner 66 | magenta | 62.9 | 60.8 | 17.8 | 55 | 8.6 | 27.8 | 65.1 |
| Toner 67 | magenta | 81.4 | 67.7 | 18.2 | 43 | 8.9 | 28.0 | 64.8 |
| Toner 68 | magenta | 62.8 | 60.7 | 17.9 | 42 | 9.0 | 28.6 | 64.4 |
| Toner 69 | cyan | 89.4 | 75.2 | 12.6 | 96 | 5.7 | 21.2 | 82.9 |
| Toner 70 | cyan | 63.8 | 61.8 | 15.7 | 40 | 8.7 | 26.0 | 68.5 |
| Toner 71 | cyan | 63.7 | 60.9 | 18.0 | 55 | 8.7 | 26.5 | 67.6 |
| Toner 72 | cyan | 89.7 | 66.5 | 15.0 | 40 | 8.7 | 27.9 | 65.2 |

TABLE 1-continued

| Toner Number | Color | Ratio of Shape Coefficient of 1.0 to 1.6 (%) | Ratio of Shape Coefficient of 1.2 to 1.6 (%) | Variation Coefficient of Shape Coefficient (%) | Ratio of Toner Particles having no Corners (%) | Number Average Particle Diameter (μm) | Variation Coefficient of Number Distribution (%) | Sum M (%) of m1 and m2 |
|---|---|---|---|---|---|---|---|---|
| Toner 73 | cyan | 63.8 | 62.2 | 15.2 | 41 | 8.7 | 28.2 | 64.8 |
| Toner 74 | cyan | 63.5 | 61.3 | 17.4 | 41 | 8.7 | 26.3 | 67.7 |
| Toner 75 | cyan | 63.4 | 61.2 | 17.7 | 53 | 9.0 | 28.9 | 66.0 |
| Toner 76 | cyan | 87.8 | 66.3 | 17.8 | 40 | 8.7 | 28.7 | 64.9 |
| Toner 77 | cyan | 63.6 | 61.3 | 18.1 | 40 | 8.9 | 28.5 | 64.9 |
| Toner 78 | black | 93.8 | 66.7 | 15.3 | 76 | 5.7 | 26.2 | 79.8 |
| Toner 79 | black | 67.9 | 64.2 | 15.2 | 44 | 8.8 | 26.6 | 67.7 |
| Toner 80 | black | 89.5 | 66.9 | 14.8 | 41 | 8.9 | 26.6 | 67.8 |
| Toner 81 | black | 68.1 | 64.0 | 17.1 | 55 | 8.8 | 26.8 | 67.7 |
| Toner 82 | black | 79.8 | 68.3 | 18.0 | 55 | 8.8 | 25.9 | 68.3 |
| Toner 83 | black | 91.4 | 67.8 | 14.8 | 58 | 8.7 | 29.0 | 64.9 |
| Toner 84 | black | 93.1 | 20.0 | 17.9 | 86 | 5.6 | 31.6 | 59.5 |
| Toner 85 | black | 72.7 | 68.1 | 15.8 | 54 | 5.8 | 26.4 | 79.7 |
| Toner 86 | black | 63.8 | 61.8 | 15.5 | 44 | 8.8 | 26.2 | 68.4 |
| Toner 87 | black | 64.0 | 62.3 | 17.1 | 57 | 8.8 | 26.4 | 67.9 |
| Toner 88 | black | 90.1 | 67.7 | 15.5 | 43 | 8.8 | 28.2 | 65.5 |

(Production of Developer Materials)

Developer materials for evaluation were prepared by mixing each of Toners 1 through 88 with a 45 μm ferrite carrier coated with styrene-methacrylate copolymer for each color in the ratio shown in Table 3.

TABLE 2

| Color | Toner | Carrier |
|---|---|---|
| Black | 19.8 g | 200.2 g |
| Yellow | 20.7 g | 209.3 g |
| Magenta | 20.7 g | 209.3 g |
| Cyan | 20.7 g | 209.3 g |

Evaluation (non-contact development method)

Evaluation was carried out employing a modified color printer "KL2010", manufactured by Konica. Conditions were as follows. Employed as a photoreceptor was a multi-layered type organic photoreceptor.

Photoreceptor surface potential: −750 V

DC bias: −610 V

AC bias: Vp-p: 2,700 V

Alternating electric field frequency: 5,000 Hz

Dsd: 570 μm

Pressure regulating force: 10 gf/mm

Pressure regulating rod: SUS416 (prepared of magnetic stainless steel)/diameter of 3 mm Thickness of developer material layer: 150 μm Development sleeve: 20 mm Accepted as a fixing device was a heat fixing device employing a pressure contact method. The constitution is described below.

Said fixing device comprises an upper roller composed of a cylindrical iron tube including at the center a 30 mm diameter heater, the surface of which is coated with a tetrafluoroethylene-perfluoroalkylvinyl ether copolymer, and a 30 mm diameter lower roller composed of silicone rubber of which surface is coated in the same manner as the upper roller with a tetrafluoroethylene-perfluoroalkylvinyl ether copolymer. The line pressure was set at 0.8 kg/cm, and the nip width was set at 4.3 mm. Employing this fixing device, the printing line speed was set at 250 mm/second. The fixing temperature was controlled by regulating the surface temperature of the upper roller, the temperature of which was set at 185° C. Further, employed as the cleaning mechanism of the fixing device was a supply method employing a web method in which polydiphenylsilicone (having a viscosity of 10,000 cp at 20° C.) was impregnated.

Under the above-mentioned conditions, image forming was carried out employing 20,000 sheets of paper. The images formed on the first sheet and the 20,000th sheet were subjected to various evaluations. Regarding the black toners, evaluated were fixing ratio (for which only the first sheet was evaluated), the density of 10 percent halftone image, line width, and fog density. Regarding the color toners, evaluated were line width and color difference of the secondary color of the images of the first sheet and the 20,000th sheet.

The formation of offsetting was separately evaluated.

Table 3 shows the results of the black toners, while Table 4 shows the result of color toners.

(Evaluation Methods)

(1) Fixing Ratio

The image density of the patch portions of a fixed image was measured by a Macbeth Reflection Densitometer "RD-918". The image density was denoted as the relative density with respect to a white sheet of paper, and the patch portions having a density of 1.00±0.05 were selected as the measurement part. Said measurement part was rubbed 14 times under a load of 22 g/cm$^2$ employing plain fabrics bleached cotton. After rubbing, the image density of the measurement part was measured and density ratio before and after rubbing was denoted as the fixing ratio.

When the fixing ratio is no less than 80 percent, a product is judged to be in the level of commercial viability.

(2) Formation of Fixing Offsetting

After longitudinally conveying 10,000 A4-size sheets having a band-shaped 5 mm wide solid image perpendicular to the conveying direction and fixing those, 10,000 A4-size sheets having a 20 mm wide halftone image perpendicular to the conveying direction were successively conveyed and temporarily terminated. After stopping the apparatus over night, it was again put into operation, and staining on the image of the first sheet due to the offsetting phenomenon and the staining on the pad were visually evaluated. The evaluation criteria are as follows. The results are shown in Table 3 below.

Evaluation Rank

Rank A: staining was formed neither on the image nor on the pad

Rank B: staining was not formed on the image, but staining was accumulated on the pad Rank C: very slight staining was formed on the image (no problem for commercial viability)

Rank D: slight staining was formed on the image (somewhat of a problem for commercial viability)

Rank E: staining was formed on the image and said image was not commercially viable (3) Density of 10 percent Halftone The relative density of a 20×20 mm image portion of 10 percent halftone was measured with respect to the white background employing a Macbeth Reflection Densitometer "RD-918".

Measurement of the density of 10 percent halftone was carried out to evaluate the reproduction of dots as well as halftone. If density variation was within 0.10, it was judged that variation in image quality is minimal enough to cause no problem.

(4) Line Width

The line width of a line image corresponding to 2-dot line image signals was measured employing a print evaluating system "RT2000" (manufactured by Yaman Co., Ltd.).

If either line width, of the image formed on the first sheet or that of the 2,000th sheet, is not more than 200 μm and the variation of the line width is less than 10 μm, fine line reproducibility is judged to be commercially viable.

(5) Fog Density

The absolute image density at 20 spots on a non-printed white sheet of paper was measured by a Macbeth Reflection Densitometer "RD-918". The obtained values were averaged and denoted as the white paper density. Subsequently, in the same manner, the absolute image density at 20 spots on the white background of an image formed for evaluation was measured, and the obtained values were averaged. The value obtained by subtracting the white paper density from said averaged density was denoted as fog density, which was employed for evaluation.

If the fog density was not more than 0.010, fog was judged to be commercially viable.

(6) Color Difference

The secondary colors (red, blue, and green) of the solid image portion in each of images formed on the first sheet and 20,000th sheet were measured by a "Macbeth Color-Eye 7000", and the color difference was calculated employing a CMC (2:1) color difference formula.

If the color difference obtained by the CMC (2:1) color difference formula was not more than 5, the variation of hue of the formed images was judged to be within the tolerance range.

Secondary colors of color toners were evaluated upon forming images employing combinations shown in Table 4.

TABLE 3

| | | | | Evaluation | First Sheet | | | 20,000th Sheet | | |
|---|---|---|---|---|---|---|---|---|---|---|
| Example No. | Toner No. | Color | Fixing Ratio (%) | Rank of Fixing Off-setting | Density of 10% Halftone | Line Width (μm) | Fog Density | Density of 10% Halftone | Line Width (μm) | Fog Density |
| Example 1 | Toner 85 | black | 95 | A | 0.09 | 186 | 0.000 | 0.13 | 190 | 0.002 |
| Example 2 | Toner 78 | black | 93 | A | 0.08 | 183 | 0.000 | 0.10 | 187 | 0.001 |
| Example 3 | Toner 7 | black | 95 | A | 0.09 | 185 | 0.000 | 0.11 | 189 | 0.001 |
| Example 4 | Toner 8 | black | 97 | A | 0.08 | 184 | 0.000 | 0.09 | 187 | 0.001 |
| Example 5 | Toner 86 | black | 83 | C | 0.10 | 187 | 0.000 | 0.17 | 195 | 0.007 |
| Example 6 | Toner 19 | black | 86 | B | 0.11 | 187 | 0.000 | 0.16 | 194 | 0.005 |
| Example 7 | Toner 20 | black | 88 | B | 0.10 | 185 | 0.000 | 0.14 | 191 | 0.004 |
| Example 8 | Toner 21 | black | 87 | B | 0.10 | 187 | 0.000 | 0.14 | 192 | 0.004 |
| Example 9 | Toner 9 | black | 87 | B | 0.10 | 186 | 0.000 | 0.17 | 191 | 0.005 |
| Example 10 | Toner 22 | black | 88 | B | 0.10 | 185 | 0.000 | 0.17 | 191 | 0.004 |
| Example 11 | Toner 79 | black | 85 | B | 0.11 | 186 | 0.000 | 0.19 | 194 | 0.005 |
| Example 12 | Toner 23 | black | 89 | B | 0.10 | 185 | 0.000 | 0.17 | 191 | 0.004 |
| Example 13 | Toner 24 | black | 91 | B | 0.10 | 187 | 0.000 | 0.16 | 192 | 0.003 |
| Example 14 | Toner 25 | black | 92 | B | 0.10 | 186 | 0.000 | 0.14 | 191 | 0.003 |
| Example 15 | Toner 10 | black | 90 | B | 0.10 | 187 | 0.000 | 0.16 | 193 | 0.004 |
| Example 16 | Toner 26 | black | 89 | B | 0.10 | 187 | 0.000 | 0.16 | 194 | 0.003 |
| Example 17 | Toner 80 | black | 86 | B | 0.11 | 188 | 0.000 | 0.18 | 196 | 0.005 |
| Example 18 | Toner 27 | black | 88 | B | 0.10 | 186 | 0.000 | 0.15 | 191 | 0.004 |
| Example 19 | Toner 16 | black | 86 | B | 0.11 | 187 | 0.000 | 0.19 | 195 | 0.006 |
| Example 20 | Toner 4 | black | 85 | B | 0.10 | 185 | 0.000 | 0.18 | 192 | 0.006 |
| Example 21 | Toner 1 | black | 82 | C | 0.09 | 183 | 0.000 | 0.17 | 191 | 0.007 |
| Example 22 | Toner 28 | black | 83 | C | 0.10 | 186 | 0.000 | 0.19 | 195 | 0.007 |
| Example 23 | Toner 29 | black | 85 | B | 0.09 | 184 | 0.000 | 0.13 | 189 | 0.006 |
| Example 24 | Toner 30 | black | 86 | B | 0.09 | 183 | 0.000 | 0.12 | 187 | 0.006 |
| Example 25 | Toner 11 | black | 91 | A | 0.09 | 183 | 0.000 | 0.12 | 188 | 0.002 |
| Example 26 | Toner 87 | black | 84 | C | 0.10 | 186 | 0.000 | 0.18 | 195 | 0.007 |
| Example 27 | Toner 31 | black | 86 | B | 0.11 | 188 | 0.000 | 0.16 | 195 | 0.005 |
| Example 28 | Toner 32 | black | 89 | B | 0.10 | 185 | 0.000 | 0.15 | 192 | 0.004 |
| Example 29 | Toner 12 | black | 88 | B | 0.10 | 186 | 0.000 | 0.15 | 193 | 0.004 |
| Example 30 | Toner 33 | black | 87 | B | 0.10 | 186 | 0.000 | 0.16 | 193 | 0.004 |
| Example 31 | Toner 81 | black | 85 | B | 0.11 | 188 | 0.000 | 0.18 | 196 | 0.006 |
| Example 32 | Toner 34 | black | 88 | B | 0.10 | 185 | 0.000 | 0.16 | 191 | 0.005 |
| Example 33 | Toner 35 | black | 90 | B | 0.10 | 186 | 0.000 | 0.15 | 191 | 0.004 |
| Example 34 | Toner 13 | black | 87 | B | 0.10 | 185 | 0.000 | 0.15 | 190 | 0.004 |
| Example 35 | Toner 36 | black | 86 | B | 0.10 | 185 | 0.000 | 0.16 | 190 | 0.004 |
| Example 36 | Toner 82 | black | 84 | B | 0.11 | 187 | 0.000 | 0.18 | 195 | 0.005 |
| Example 37 | Toner 17 | black | 85 | B | 0.11 | 188 | 0.000 | 0.19 | 196 | 0.006 |
| Example 38 | Toner 5 | black | 84 | B | 0.11 | 188 | 0.000 | 0.18 | 195 | 0.006 |

TABLE 3-continued

| | | | | Evaluation | First Sheet | | | 20,000th Sheet | | |
|---|---|---|---|---|---|---|---|---|---|---|
| Example No. | Toner No. | Color | Fixing Ratio (%) | Rank of Fixing Off-setting | Density of 10% Halftone | Line Width (μm) | Fog Density | Density of 10% Halftone | Line Width (μm) | Fog Density |
| Example 39 | Toner 2 | black | 83 | C | 0.10 | 185 | 0.000 | 0.18 | 191 | 0.008 |
| Example 40 | Toner 37 | black | 83 | C | 0.10 | 184 | 0.000 | 0.19 | 193 | 0.007 |
| Example 41 | Toner 38 | black | 86 | B | 0.09 | 183 | 0.000 | 0.15 | 188 | 0.004 |
| Example 42 | Toner 39 | black | 85 | B | 0.09 | 182 | 0.000 | 0.14 | 187 | 0.004 |
| Example 43 | Toner 14 | black | 92 | A | 0.09 | 184 | 0.000 | 0.12 | 189 | 0.002 |
| Example 44 | Toner 88 | black | 84 | C | 0.10 | 186 | 0.000 | 0.17 | 193 | 0.005 |
| Example 45 | Toner 40 | black | 88 | B | 0.10 | 185 | 0.000 | 0.16 | 191 | 0.004 |
| Example 46 | Toner 41 | black | 90 | B | 0.10 | 186 | 0.000 | 0.15 | 191 | 0.003 |
| Example 47 | Toner 15 | black | 87 | B | 0.10 | 186 | 0.000 | 0.15 | 192 | 0.004 |
| Example 48 | Toner 42 | black | 88 | B | 0.10 | 187 | 0.000 | 0.16 | 193 | 0.004 |
| Example 49 | Toner 83 | black | 85 | B | 0.11 | 188 | 0.000 | 0.18 | 195 | 0.005 |
| Example 50 | Toner 18 | black | 86 | B | 0.11 | 187 | 0.000 | 0.19 | 194 | 0.005 |
| Example 51 | Toner 6 | black | 85 | B | 0.11 | 187 | 0.000 | 0.18 | 195 | 0.005 |
| Example 52 | Toner 3 | black | 83 | C | 0.10 | 185 | 0.000 | 0.17 | 193 | 0.007 |
| Example 53 | Toner 43 | black | 83 | C | 0.10 | 187 | 0.000 | 0.18 | 194 | 0.008 |
| Example 54 | Toner 44 | black | 86 | B | 0.10 | 185 | 0.000 | 0.15 | 189 | 0.004 |
| Example 55 | Toner 45 | black | 85 | B | 0.11 | 186 | 0.000 | 0.17 | 192 | 0.004 |
| Comparative Example 1 | Toner 46 | black | 73 | D | 0.11 | 192 | 0.000 | 0.22 | 215 | 0.011 |
| Comparative Example 2 | Toner 47 | black | 74 | D | 0.11 | 190 | 0.000 | 0.24 | 214 | 0.013 |
| Comparative Example 3 | Toner 48 | black | 71 | D | 0.11 | 191 | 0.000 | 0.23 | 213 | 0.011 |
| Comparative Example 4 | Toner 49 | black | 72 | D | 0.12 | 193 | 0.000 | 0.24 | 220 | 0.012 |
| Comparative Example 5 | Toner 50 | black | 67 | E | 0.13 | 195 | 0.001 | 0.26 | 225 | 0.014 |
| Comparative Example 6 | Toner 84 | black | 70 | D | 0.11 | 193 | 0.000 | 0.22 | 220 | 0.011 |

TABLE 4

| | | | Evaluation Rank of Fixing | First Sheet Line Width | 20,000th Sheet Line Width | Color Difference | | |
|---|---|---|---|---|---|---|---|---|
| Example No. | Toner No. | Color | Offsetting | (μm) | (μm) | R | B | G |
| Example 56 | Toner 51 | yellow | A | 182 | 186 | 3.2 | 2.9 | 3.3 |
| Example 57 | Toner 60 | magenta | A | 183 | 186 | | | |
| Example 58 | Toner 69 | cyan | A | 185 | 188 | | | |
| Example 59 | Toner 52 | yellow | C | 186 | 194 | 4.3 | 4.5 | 4.1 |
| Example 60 | Toner 61 | magenta | C | 187 | 195 | | | |
| Example 61 | Toner 70 | cyan | C | 185 | 193 | | | |
| Example 62 | Toner 53 | yellow | C | 183 | 191 | 4.2 | 4.7 | 4.5 |
| Example 63 | Toner 62 | magenta | C | 183 | 192 | | | |
| Example 64 | Toner 71 | cyan | C | 185 | 193 | | | |
| Example 65 | Toner 54 | yellow | C | 187 | 196 | 4.4 | 4.3 | 4.8 |
| Example 66 | Toner 63 | magenta | C | 185 | 194 | | | |
| Example 67 | Toner 72 | cyan | C | 184 | 192 | | | |
| Comparative Example 7 | Toner 55 | yellow | D | 189 | 216 | 10.3 | 11.5 | 9.8 |
| Comparative Example 8 | Toner 64 | magenta | D | 190 | 213 | | | |
| Comparative Example 9 | Toner 73 | cyan | D | 191 | 213 | | | |
| Comparative Example 10 | Toner 56 | yellow | D | 189 | 214 | 11.2 | 9.8 | 9.9 |
| Comparative Example 11 | Toner 65 | magenta | D | 191 | 220 | | | |
| Comparative Example 12 | Toner 74 | cyan | D | 192 | 217 | | | |
| Comparative Example 13 | Toner 57 | yellow | D | 190 | 216 | 10.6 | 11.6 | 10.1 |
| Comparative Example 14 | Toner 66 | magenta | D | 189 | 214 | | | |
| Comparative Example 15 | Toner 75 | cyan | D | 188 | 212 | | | |

TABLE 4-continued

| Example No. | Toner No. | Color | Evaluation Rank of Fixing Offsetting | First Sheet Line Width (μm) | 20,000th Sheet Line Width (μm) | Color Difference R | B | G |
|---|---|---|---|---|---|---|---|---|
| Comparative Example 16 | Toner 58 | yellow | D | 190 | 215 | 10.2 | 9.7 | 10.8 |
| Comparative Example 17 | Toner 67 | magenta | D | 191 | 218 | | | |
| Comparative Example 18 | Toner 76 | cyan | D | 189 | 212 | | | |
| Comparative Example 19 | Toner 59 | yellow | E | 195 | 223 | 11.7 | 12.7 | 13.2 |
| Comparative Example 20 | Toner 68 | magenta | E | 196 | 224 | | | |
| Comparative Example 21 | Toner 77 | cyan | E | 194 | 221 | | | |

As described above, when images are formed employing the present embodiments, offsetting is minimized; fixing property is improved; variation of image quality during repeated image formation is minimized; and color differences of the secondary color is also minimized.

The toner of the present invention is capable of forming images which exhibit minimal offsetting, excellent fixing property, developability, fine line reproducibility, and forming high quality images over a long period of time.

The image forming method of the present invention is capable of forming images, which exhibit minimal in offsetting, excellent fixing property, developability, fine line reproducibility, and forming high quality images over a long period of time.

What is claimed:

1. A toner for developing electrostatic image comprising a resin and colorant wherein the toner has a variation coefficient of shape coefficient of not more than 16 percent and a number variation coefficient in the number particle size distribution of not more than 27 percent.

2. The toner of claim 1 wherein at least 65 percent of toner particles has a shape coefficient in the range of 1.0 to 1.6.

3. The toner of claim 1 wherein at least 65 percent of toner particles has a shape coefficient in the range of 1.2 to 1.6.

4. The toner of claim 1 wherein at least 50 percent of toner particles in number have no corners.

5. The toner of claim 1 wherein number average particle diameter of toner particles is 3 to 8 μm.

6. The toner of claim 1 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

7. The toner of claim 1 wherein the toner is prepared by polymerizing polymerizable monomers an aqueous medium.

8. The toner of claim 1 wherein the toner is prepared by a method wherein resin particles are associated in an aqueous medium.

9. The toner of claim 1 wherein at least 65 percent of toner particles has a-shape coefficient in the range of 1.2 to 1.6 and at least 50 percent of toner particles in number have no corners.

10. A toner for developing electrostatic image comprising a resin and colorant wherein at least 50 percent of toner particles in number have no corners and the toner particles have a number variation coefficient in the number particle size distribution of not more than 27 percent.

11. The toner of claim 10 wherein at least 65 percent of toner particles has a shape coefficient in the range of 1.0 to 1.6.

12. The toner of claim 10 wherein at least 65 percent of toner particles has a shape coefficient in the range of 1.2 to 1.6.

13. The toner of claim 10 wherein number average particle diameter of toner particles is 3 to 8 μm.

14. The toner of claim 10 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

15. The toner of claim 10 wherein the toner is prepared by polymerizing polymerizable monomers an aqueous medium.

16. The toner of claim 10 wherein the toner is prepared by a method wherein resin particles are associated in an aqueous medium.

17. The toner of claim 12 wherein number average particle diameter of toner particles is 3 to 8 μm.

18. A toner for developing electrostatic image comprising a resin and colorant wherein at least 65 percent of toner particles has a shape coefficient in the range of 1.0 to 1.6 and a variation coefficient of shape coefficient of not more than 16.

19. The toner of claim 18 wherein at least 50 percent of toner particles in number have no corners.

20. The toner of claim 18 wherein number average particle diameter of toner particles is 3 to 8 μm.

21. The toner of claim 18 wherein the has a sum M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

22. The toner of claim 18 wherein the toner is prepared by polymerizing polymerizable monomers an aqueous medium.

23. The toner of claim 18 wherein the toner is prepared by a method wherein resin particles are associated in an aqueous medium.

24. An image forming method in which an electrostatic latent image formed on photoreceptor and a developer material are arranged face to face in a non-contact state and images are visualized by jumping only toner comprising resin and colorant, wherein the toner has a variation coefficient of shape coefficient of not more than 16 percent and a number variation coefficient in the number particle size distribution of not more than 27 percent.

25. The image forming method of claim 24 wherein at least 65 percent of toner particles has a shape coefficient in the range of 1.0 to 1.6.

26. The image forming method of claim 24 wherein at least 65 percent of toner particles has a shape coefficient in the range of 1.2 to 1.6.

27. The image forming method of claim 24 wherein at least 50 percent of toner particles in number have no corners.

28. The image forming method of claim 24 wherein number average particle diameter of toner particles is 3 to 8 μm.

29. The image forming method of claim 24 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

30. The image forming method of claim 24 wherein the toner is prepared by polymerizing polymerizable monomers an aqueous medium.

31. The image forming method of claim 24 wherein the toner is prepared by a method wherein resin particles are associated in an aqueous medium.

32. An image forming method in which an electrostatic latent image formed on photoreceptor and a developer material are arranged face to face in a non-contact state and images are visualized by jumping only toner comprising resin and colorant, wherein at least 50 percent of toner particles in number have no corners and a number variation coefficient in the number particle size distribution of not more than 27 percent.

33. The image forming method of claim 32 wherein at least 65 percent of toner particles has a shape coefficient in the range of 1.0 to 1.6.

34. The image forming method of claim 32 wherein at least 65 percent of toner particles has a shape coefficient in the range of 1.2 to 1.6.

35. The image forming method of claim 32 wherein number average particle diameter of toner particles is 3 to 8 μm.

36. The image forming method of claim 32 wherein the toner has M of at least 70 percent, M being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

37. An image forming method of claim 32 wherein the toner is prepared by polymerizing polymerizable monomers an aqueous medium.

38. An image forming method of claim 32 wherein the toner is prepared by a method wherein resin particles are associated in an aqueous medium.

39. An image forming method in which an electrostatic latent image formed on photoreceptor and a developer material are arranged face to face in a non-contact state and images are visualized by jumping only toner comprising resin and colorant, wherein at least 65 percent of toner particles has a shape coefficient in the range of 1.2 to 1.6 and the toner has a variation coefficient of shape coefficient of not more than 16 percent.

40. The image forming method of claim 39 wherein at least 50 percent of toner particles in number have no corners.

41. The image forming method of claim 39 wherein number average particle diameter of toner particles is 3 to 8 μm.

42. The image forming method of claims 39 wherein the toner has N of at least 70 percent, N being sum of m1 and m2 wherein m1 is relative frequency of toner particles, included in the most frequent class, and m2 is relative frequency of toner particles included in the second frequent class in a histogram showing the particle size distribution, which is drawn in such a manner that natural logarithm lnD is used as an abscissa, wherein D (in μm) represents the particle diameter of a toner particle, while being divided into a plurality of classes at intervals of 0.23, and number of particles is used as an ordinate.

43. The image forming method of claim 39 wherein the toner is prepared by polymerizing polymerizable monomers an aqueous medium.

44. An image forming method of claim 39 wherein the toner is prepared by a method wherein resin particles are associated in an aqueous medium.

* * * * *

UNITED STATES PATENT AND TRADEMARK OFFICE

CERTIFICATE OF CORRECTION

PATENT NO. : 6,296,980 B1 
DATED : October 2, 2001
INVENTOR(S) : Oshiba et al.

It is certified that error appears in the above-identified patent and that said Letters Patent is hereby corrected as shown below:

Title page,
Item [75], Inventors should read -- Tomomi Oshiba; Ken Ohmura; Takao Yamanouchi; Asao Matsushima; Shigenori Kouno; Hiroyuki Yamada; Hiroshi Yamazaki --

Signed and Sealed this

Fifteenth Day of October, 2002

*Attest:*

*Attesting Officer*

JAMES E. ROGAN
*Director of the United States Patent and Trademark Office*